US009212506B2

(12) United States Patent
Murphy et al.

(10) Patent No.: US 9,212,506 B2
(45) Date of Patent: Dec. 15, 2015

(54) SYSTEM AND METHOD FOR ADJUSTING THE SPRING TORQUE OF A LOCK CHASSIS

(75) Inventors: Nathanael S. Murphy, Colorado Springs, CO (US); Dale M. Collins, Colorado Springs, CO (US); Kenton H. Barker, Colorado Springs, CO (US); Brian K. Roth, Elbert, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 807 days.

(21) Appl. No.: 13/414,808

(22) Filed: Mar. 8, 2012

(65) Prior Publication Data

US 2013/0234453 A1 Sep. 12, 2013

(51) Int. Cl.

| | |
|---|---|
| ***E05B 3/00*** | (2006.01) |
| ***E05B 55/00*** | (2006.01) |
| ***E05B 63/00*** | (2006.01) |
| *E05B 15/04* | (2006.01) |

(52) U.S. Cl.

CPC ..... *E05B 55/005* (2013.01); *E05B 63/0065* (2013.01); *E05B 2015/0431* (2013.01); *E05B 2015/0448* (2013.01); *Y10T 292/108* (2015.04); *Y10T 292/1059* (2015.04)

(58) Field of Classification Search

CPC ..... E05B 3/065; E05B 15/04; E05B 55/005; E05B 63/0065; E05B 2015/0431; E05B 2015/0448; Y10T 292/1059; Y10T 292/108

USPC ..... 292/226, 137, 336.3, 357, DIG. 60, 292/DIG. 61, 347, 348; 70/224

See application file for complete search history.

(56) References Cited

U.S. PATENT DOCUMENTS

| | | | | |
|---|---|---|---|---|
| 2,729,485 | A * | 1/1956 | Schlage | 292/1 |
| 4,163,376 | A | 8/1979 | Miller et al. | |
| 4,569,547 | A * | 2/1986 | Fayerman et al. | 292/347 |
| 4,876,783 | A | 10/1989 | Campion et al. | |
| 5,553,521 | A | 9/1996 | Dunn | |
| 5,564,296 | A | 10/1996 | Theriault et al. | |
| 5,752,399 | A | 5/1998 | Shen | |
| 6,532,779 | B2 | 3/2003 | Shen | |
| 6,557,909 | B2 * | 5/2003 | Morris | 292/169.15 |
| 6,640,593 | B1 | 11/2003 | Hannah et al. | |
| 7,334,440 | B2 | 2/2008 | Hsueh et al. | |
| 2002/0116964 | A1 | 8/2002 | Koskela et al. | |
| 2002/0117866 | A1 | 8/2002 | Bates et al. | |

(Continued)

OTHER PUBLICATIONS

PCT/US2013/028992 International Search Report and Written Opinion dated Jun. 17, 2013 (7 pages).

*Primary Examiner* — Kristina Fulton
*Assistant Examiner* — Christine M Mills
(74) *Attorney, Agent, or Firm* — Michael Best & Friedrich LLP

(57) ABSTRACT

A latch assembly configured to attach to a door includes one of a knob and a lever. The latch assembly further includes a latch extending from the door. A spindle is rotatable from a first position to a second position to move the latch from an extended position to a retracted position. A first biasing member is selectively operable to bias the spindle toward the first position. A second biasing member is selectively operable to bias the spindle toward the first position. An actuator is movable between a knob position in which only one of the first biasing member and the second biasing member biases the spindle toward the first position and a lever position in which both the first biasing member and the second biasing member cooperate to bias the spindle toward the first position.

18 Claims, 21 Drawing Sheets

(56) References Cited

U.S. PATENT DOCUMENTS

| | | | | |
|---|---|---|---|---|
| 2002/0117868 | A1 | 8/2002 | Bates et al. | |
| 2003/0107223 | A1 | 6/2003 | Chong et al. | |
| 2003/0131640 | A1 | 7/2003 | Eller et al. | |
| 2006/0043742 | A1 * | 3/2006 | Huang et al. | 292/336.3 |
| 2010/0139335 | A1 * | 6/2010 | Constantinou | 70/57 |
| 2010/0264672 | A1 * | 10/2010 | Ellis | 292/87 |
| 2011/0006550 | A1 | 1/2011 | Cho | |
| 2011/0203326 | A1 * | 8/2011 | Lin | 70/1.5 |
| 2011/0233942 | A1 * | 9/2011 | Shen | 292/58 |

* cited by examiner

SYSTEM AND METHOD FOR ADJUSTING THE SPRING TORQUE OF A LOCK CHASSIS

BACKGROUND

The present invention relates to a device and method for selecting between spring rates in a single lock set assembly that supports multiple lockset trim types.

A conventional door knob has a center of mass centered with the axis of the lock spindle. A conventional door lever, in contrast, has a center of mass offset some distance from the spindle axis. The gravitational force on this center of mass produces a torque about the spindle axis. To provide a counter torque to maintain the neutral position of the lever in a horizontal plane and to also resist increased operator torque due to the inherent mechanical advantage afforded a lever, a stiffer spring or additional springs are typically included in lock assemblies on which a lever will be installed. This is usually accomplished by manufacturing two separate lock assembly configurations: one with lighter springs for knobs, and a second one with heavier springs for levers.

SUMMARY

In one embodiment of a latch assembly configured to attach to a door, the latch assembly includes one of a knob and a lever. The latch assembly further includes a latch extending from the door. A spindle is rotatable from a first position to a second position to move the latch from an extended position to a retracted position. A first biasing member is selectively operable to bias the spindle toward the first position. A second biasing member is selectively operable to bias the spindle toward the first position. An actuator is movable between a knob position in which only one of the first biasing member and the second biasing member biases the spindle toward the first position and a lever position in which both the first biasing member and the second biasing member cooperate to bias the spindle toward the first position.

In one embodiment of a latch assembly configured to attach to a door, the latch assembly includes a latch extending from the door. A housing is coupled to the door and has an aperture defining a central axis therethrough. A spindle is received and configured to rotate within the aperture and to extend and retract the latch. First and second biasing springs are contained within the housing. An actuator is selectively movable to an operable position in which rotation of the spindle deflects the first and second biasing spring, and an inoperable position in which rotation of the spindle deflects only the first biasing spring.

In one embodiment of a latch assembly configured to attach to a door, the latch assembly includes a spindle rotatable about a central axis to move a latch from an extended position to a retracted position in the door. An annular plate is fixed with respect to the door and includes a slot, a first face, and a projection extending from the first face. A retainer member includes a first face, a first protrusion extending from the first face, and a second protrusion extending from the first face. The retainer member is coupled to the spindle and rotatable about the central axis. A first spring is disposed between the first face of the annular plate and the first face of the retainer member. A second spring is disposed between the first face of the annular plate and the first face of the retainer member. The first and second springs are movable with the projection, the first protrusion, and the second protrusion. An actuator is selectively movable between a retracted position and an extended position through the slot to place the first and second springs into a mechanically parallel relationship.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. And as used herein and in the appended claims, the terms "upper", "lower", "top", "bottom", "front", "back", and other directional terms are not intended to require any particular orientation, but are instead used for purposes of description only.

Figure 1:
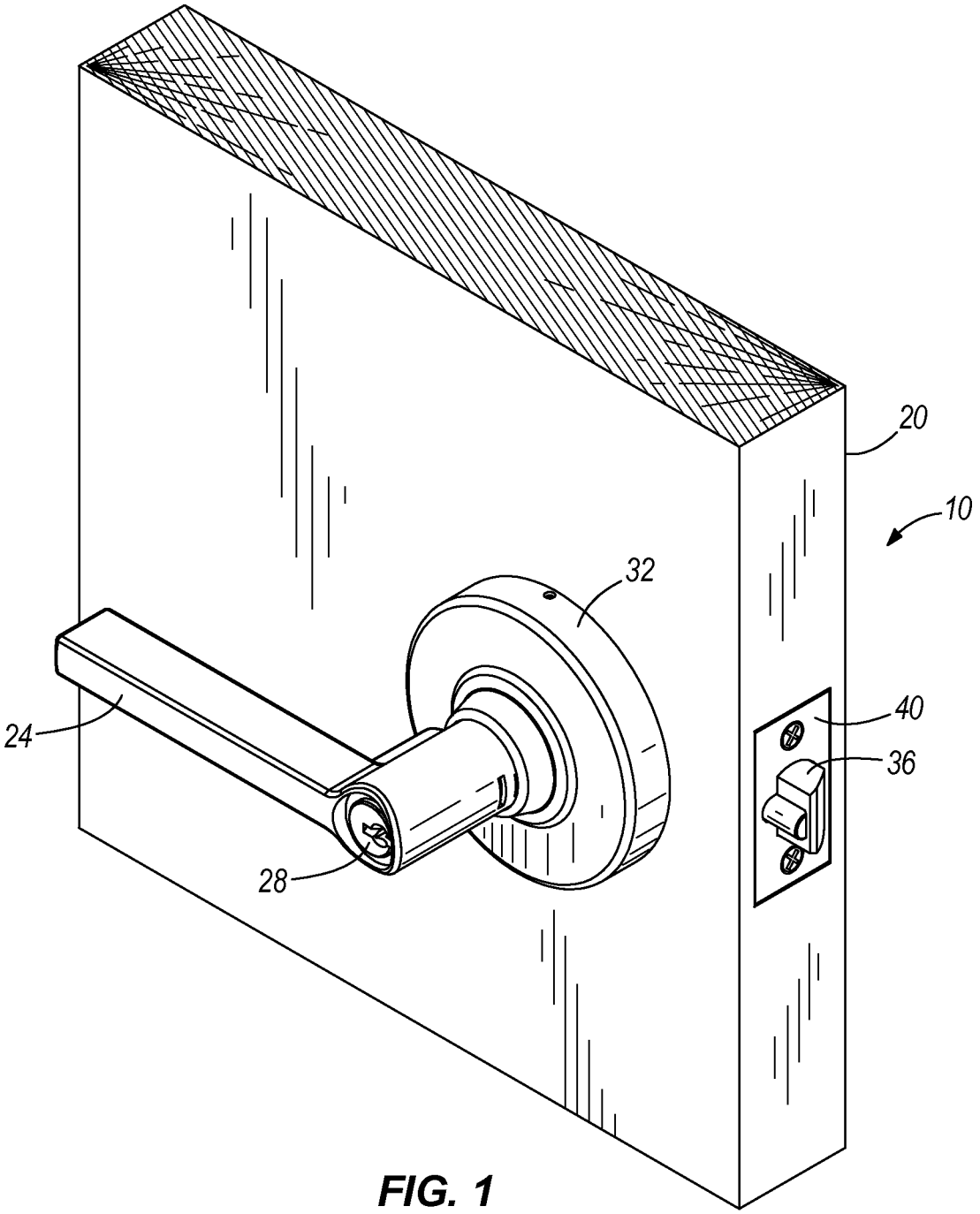
FIG. 1 is a perspective view of a lock assembly having a lever handle.

FIG. 1 illustrates the external portions of a lock assembly 10 mounted within a door 20. As illustrated, the lock assembly 10 includes a lever 24 housing a key cylinder 28 with a cover 32 to conceal the interface of internal components of the lock assembly 10 with the door 20. A latch 36 extends through a faceplate 40 mounted in the swing side end of the door 20 adjacent an opposing door frame (not shown).

Figure 2A:
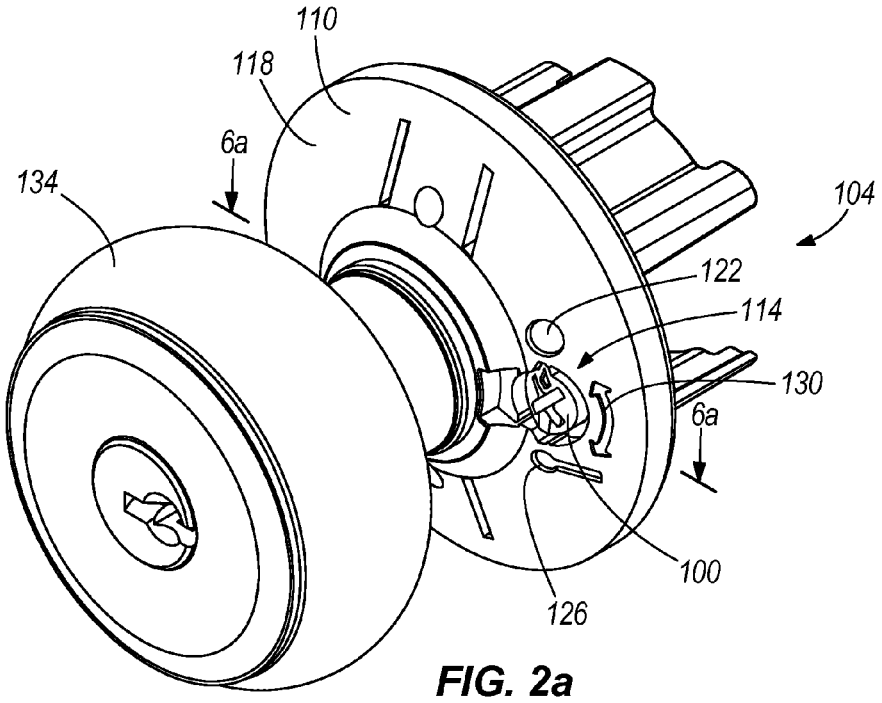
FIG. 2*a* is a perspective view of a selectable lock assembly with a knob handle.
Figure 2B:
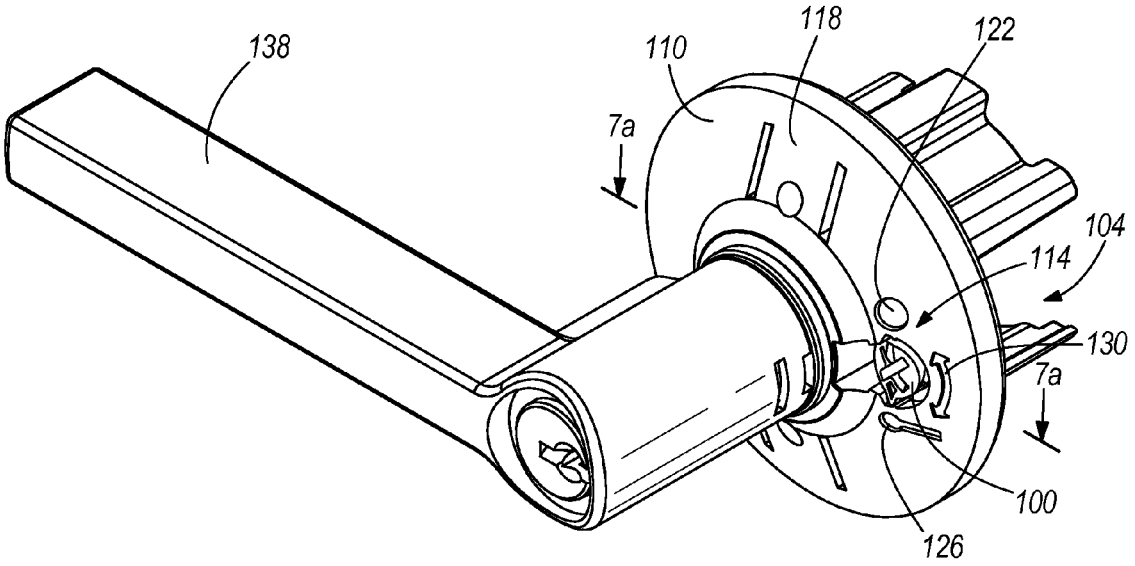
FIG. 2*b* is a perspective view of the selectable lock assembly of FIG. 2*a* with a lever handle.

Referring to FIGS. 2*a* and 2*b*, an externally accessible selector 100 for adjusting the internal spring torque of a selectable lockset assembly 104 is disposed within a housing 110. The housing 110 includes a position identifier 114 integrally formed as part of a front face 118 to enable a user to identify whether the lockset is configured for use with a knob (i.e., a knob icon 122) or a lever (i.e., a lever icon 126). A directional arrow 130 indicates the direction in which to rotate the selector 100 to achieve the desired state. FIG. 2*a* shows the selector 100 configured for a knob 134, while FIG. 2*b* shows the selector 100 configured for a lever 138.

Figure 3A:
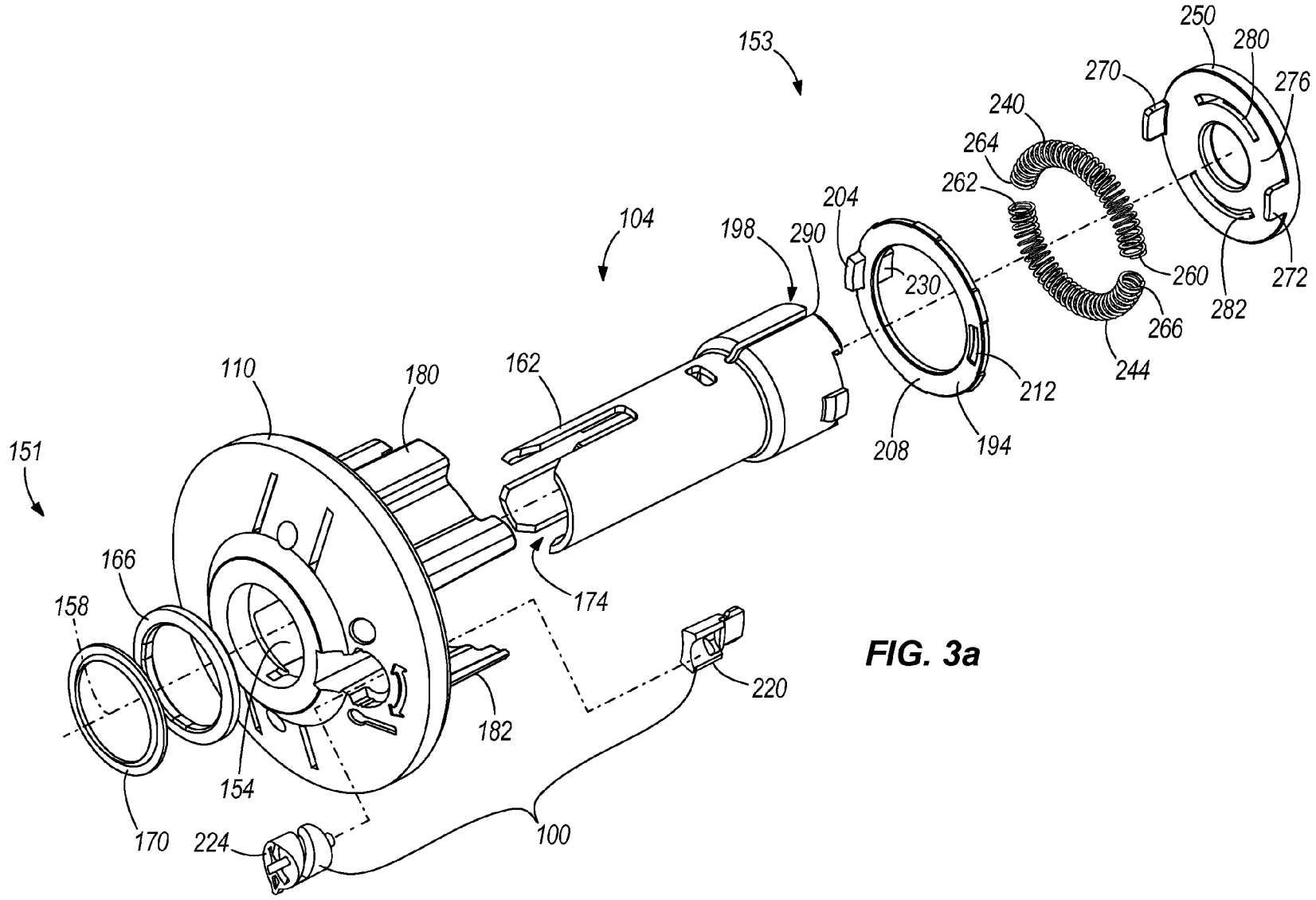
FIG. 3*a* is an exploded view of the selectable lock assembly of FIGS. 2*a* and 2*b*.
Figure 3B:
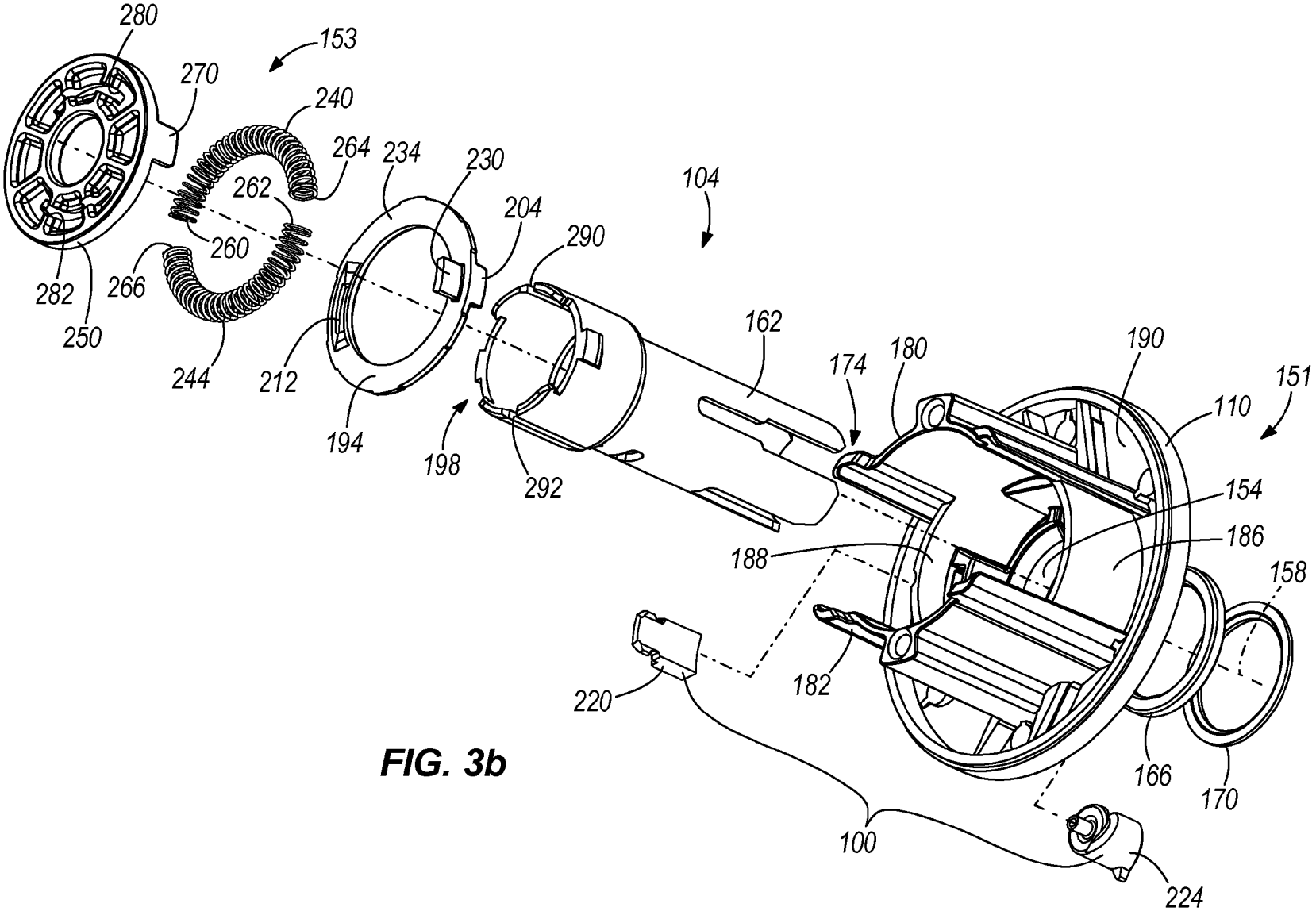
FIG. 3*b* is an exploded view of the selectable lock assembly of FIGS. 2*a* and 2*b*.
Figure 3C:
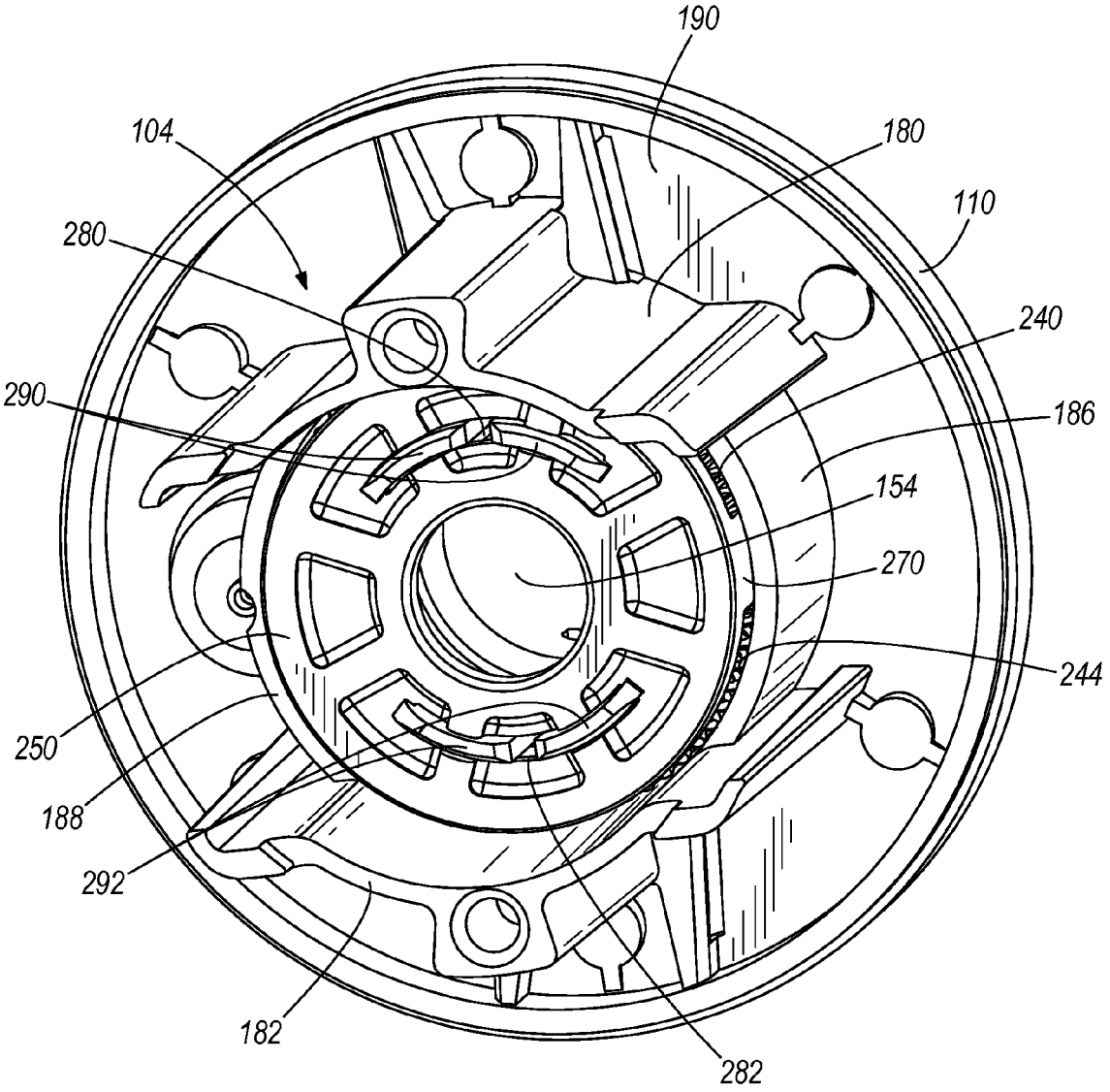
FIG. 3*c* is another perspective view of the selectable lock assembly of FIGS. 2*a* and 2*b*.

FIGS. 3*a* and 3*b* illustrate the selectable lock assembly 104 referenced with respect to a proximal end 151 and a distal end 153. FIG. 3*c* illustrates the lock assembly 104 as assembled. Referring to FIGS. 3*a*-3*c*, the lock housing 110 defines an aperture 154 having a central axis 158. The aperture 154 receives a spindle 162 therethrough, which rotates in response to actuation of the handle 134 or the lever 138 (see, e.g., FIGS. 2*a* and 2*b*) to move a latch (not shown) from an extended position to a refracted position. The spindle 162 is externally secured through a retainer 166 and a retainer ring 170 that seat against the housing 110. The spindle 162 receives a lock cylinder (not shown) into a proximal end 174 thereof in a manner known to those of skill in the art. Two elongated members 180, 182, connected by arcuate sections 186, 188, extend from a distal face 190 of the housing 110 and are together shaped to contain the remaining components of the selectable lock assembly 104 and further provide fixed reference points.

With continued reference to FIGS. 3*a*-3*c*, an annular back plate 194 concentric with the axis 158 receives the distal end 198 of the spindle 162. The back plate 194 includes a housing catch 204 projecting from a proximal face 208 that secures the back plate 194 within the housing 110 to inhibit relative rotation during operation. A slot 212 through the back plate 194 is diametrically spaced from the housing catch 204 and receives an actuator 220 that is operationally engaged by an adjustment member 224 of the selector 100, as will be subsequently detailed. The slot 212 may be wholly bounded by the back plate 194 or may be disposed circumferentially at the edge of the plate 194, i.e., as a notch. A projection or stop 230 extending from the distal face 234 of the back plate 194 opposite the housing catch 204 passively interacts with two substantially coplanar biasing members or springs—an upper spring 240 and a lower spring 244—functionally positioned between the back plate 194 and a retainer member 250. The biasing springs 240, 244 as illustrated are linear compression springs, each with a respective first end 260, 262 and a second end 264, 266. The spring constants of the biasing springs 240, 244 will normally be substantially similar. A pair of opposing protrusions 270, 272 extending from the proximal face 276 of the retainer member 250 actively interact with the two biasing springs 240, 244, as will be further described below. The retainer member 250 includes two generally curvilinear openings 280, 282 therethrough that mate with conforming slotted extensions 290, 292 formed at the distal end 198 of the spindle 162 such that the retainer member 250 rotates with the spindle 162. The spindle 162, annular back plate 194, retainer member 250, members 180, 182, and sections 186, 188, assembled together, form an arcuate channel within which the biasing springs 240, 244 can translate and deflect during operation.

Figure 4:
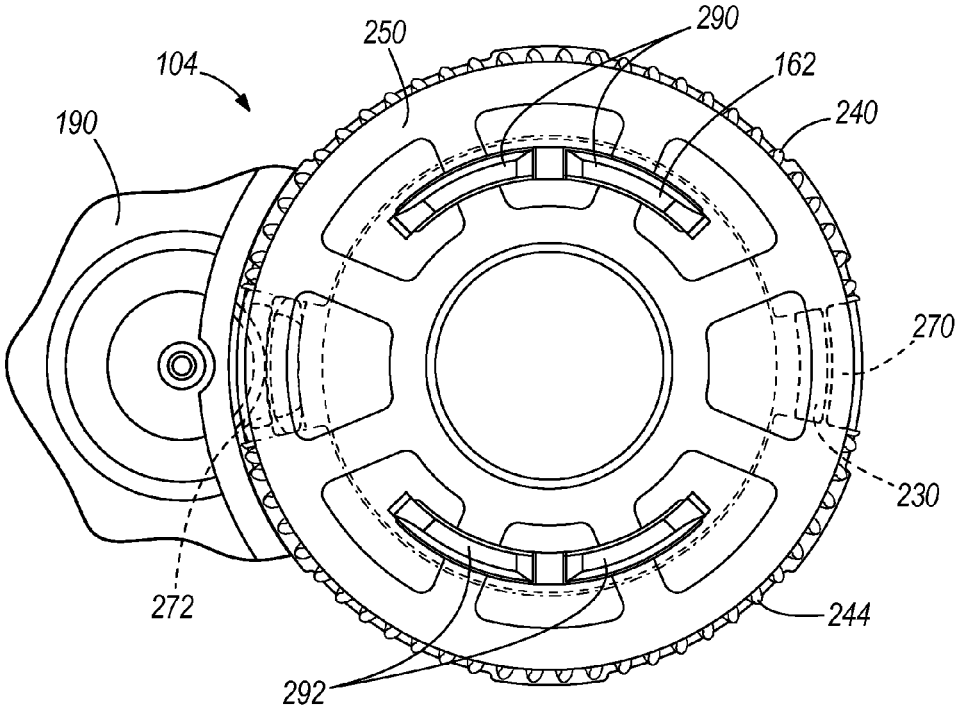
FIG. 4 is an end view of the selectable lock assembly of FIGS. 2*a* and 2*b* in a neutral position.

Referring to FIG. 4, a distal end view of the lock assembly 104 is illustrated in a neutral position, in which the handle, either the knob 134 or the lever 138 (not shown), is inactive and therefore does not generate a torque to rotate the spindle 162. This is further reflected by the substantially horizontally positioned protrusions 270, 272 of the retainer member 250. The biasing springs 240, 244 are consequently both in a relaxed state between the protrusions 270, 272 and on either side of the stop 230.

Figure 5A:
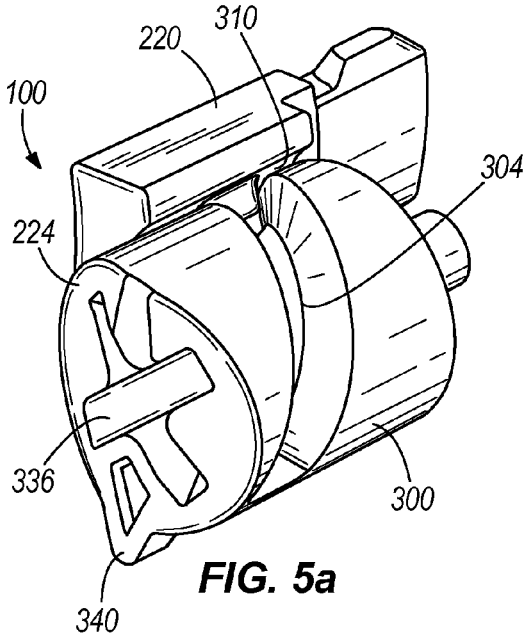
FIG. 5*a* is a perspective view of the selector of the selectable lock assembly of FIGS. 2*a* and 2*b*.
Figure 5B:
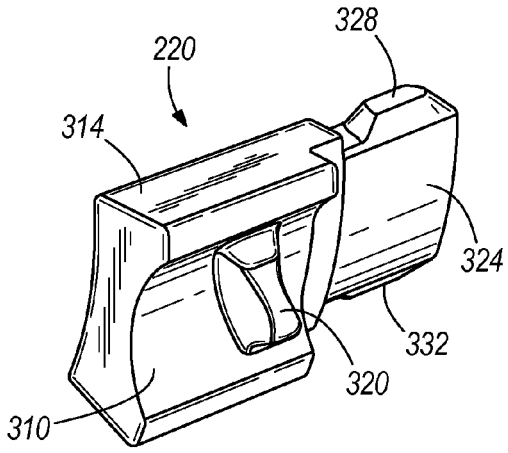
FIG. 5*b* is a perspective view of the positioning member of the selector of FIG. 5*a*.

Referring to FIGS. 5*a* and 5*b*, the adjustment member 224 of the selector 100 is formed from a generally cylindrical shaft 300, which defines a single thread root 304. The shaft 300 is operable to rotate adjacent a complementary surface 310 formed in a proximal portion 314 of the actuator 220. A partial thread crest 320 protrudes from the surface 310 to engage the thread root 304 and transform rotational motion of the adjustment member 224 to linear motion of the actuator 220 in the direction of the central axis 158. A positioning member 324 of the actuator 220 includes first and second contact surfaces 328, 332 to interact with the biasing springs 240, 244 when the selector 100 is actuated, as will be further detailed below. An engagement interface 336 of the adjustment member 224 is operable with a screwdriver or similar tool, though additional configurations for manually rotating the adjustment member 224 are within the knowledge and skill of those in the art. An indicator 340 cooperates with the position identifier 114 of FIGS. 2*a* and 2*b* and identifies whether the selector 100 is currently configured for a knob or a lever.

Figure 6A:
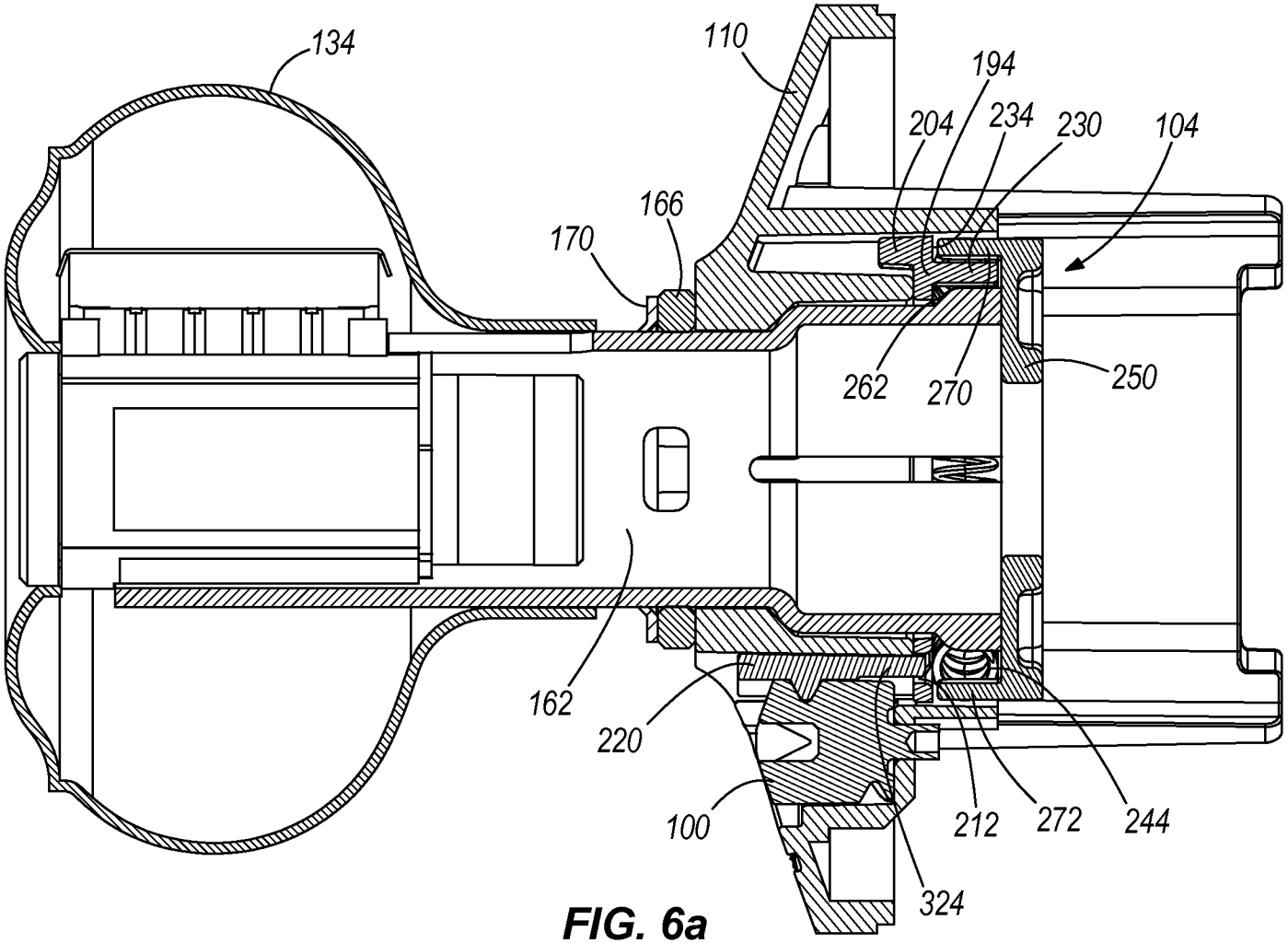
FIG. 6*a* is a section view taken along line 6*a*-6*a* of FIG. 2*a*.
Figure 6B:
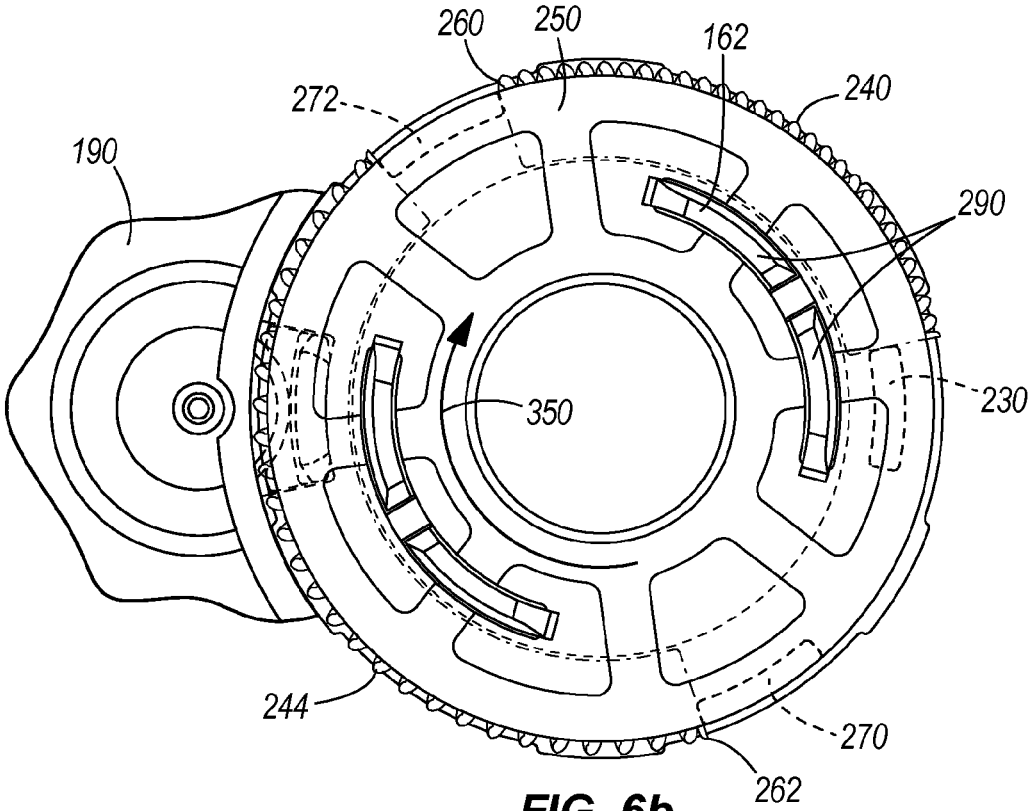
FIG. 6*b* is an end view of the lock assembly of FIG. 6*a* with clockwise rotation of the spindle.
Figure 6C:
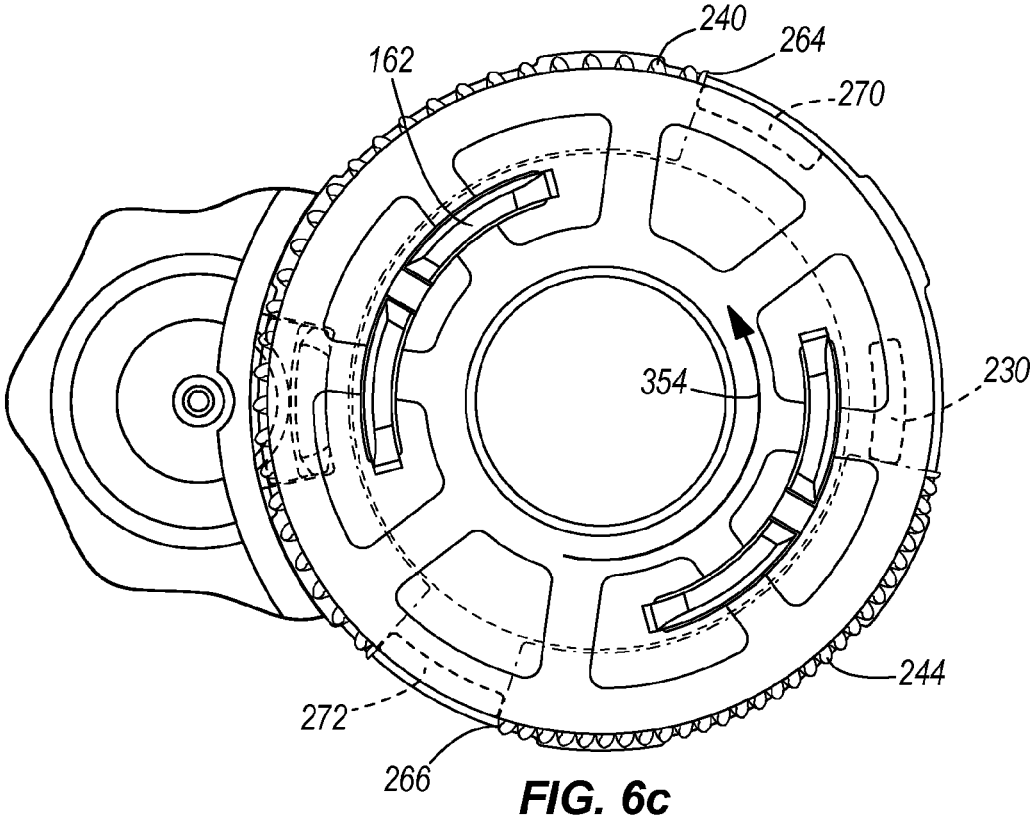
FIG. 6*c* is an end view of the lock assembly of FIG. 6*a* with counterclockwise rotation of the spindle.

FIGS. 6*a*-6*c* show a knob configuration. Referring to FIG. 6*a*, the locking assembly 104 is shown in a neutral position with no torque applied to the knob 134. The stop 230 extending from the distal face 234 of the back plate 194 is shown in its fixed position adjacent the first end 262 of the lower biasing spring 244 (and equally adjacent to the second end 264 of the upper biasing spring 240, not shown). As illustrated, in the knob configuration, the actuator 220 is retracted, i.e., proximally positioned, and does not extend through the slot 212 in the annular back plate 194.

Referring to FIG. 6*b*, in operation, during a clockwise rotation of the spindle 162 (see arrow 350) due to rotation of the knob 134 (not shown), the protrusion 272 of the retainer member 250 contacts the first end 260 of the upper biasing spring 240 and compresses the upper biasing spring 240 against the back plate stop 230. This provides a counter torque to the applied torque of the knob. The lower biasing spring 244, contacted at end 262 by the protrusion 270, slides within the housing 110 in a circumferential path defined between the back plate 194 and the retainer member 250 and moves with and between the opposing protrusions 270, 272. The lower biasing spring 244 is therefore not compressed and provides no counter torque to the applied torque of the knob. Referring to FIG. 6*c*, during a counterclockwise rotation of the spindle 162 (see arrow 354), the protrusion 272 contacts the second end 266 of the lower biasing spring 244 and compresses the lower biasing spring 244 against the back plate stop 230. Due to the relatively equal spring constants between the upper and lower biasing springs 240, 244, this motion provides an equal counter torque to the knob as is applied during clockwise rotation of the spindle 162. The upper biasing spring 240, contacted at end 264 by the protrusion 270, slides within the circumferential path described above and moves with and between the opposing protrusions 270, 272. The upper biasing spring 240 is therefore not compressed and provides no counter torque to the applied torque of the knob. In FIGS. 6*b*-6*c*, neither one of the first or second contact surfaces 328, 332 of the positioning member 324 interferes with the motion of the biasing springs 240, 244.

Figure 7A:
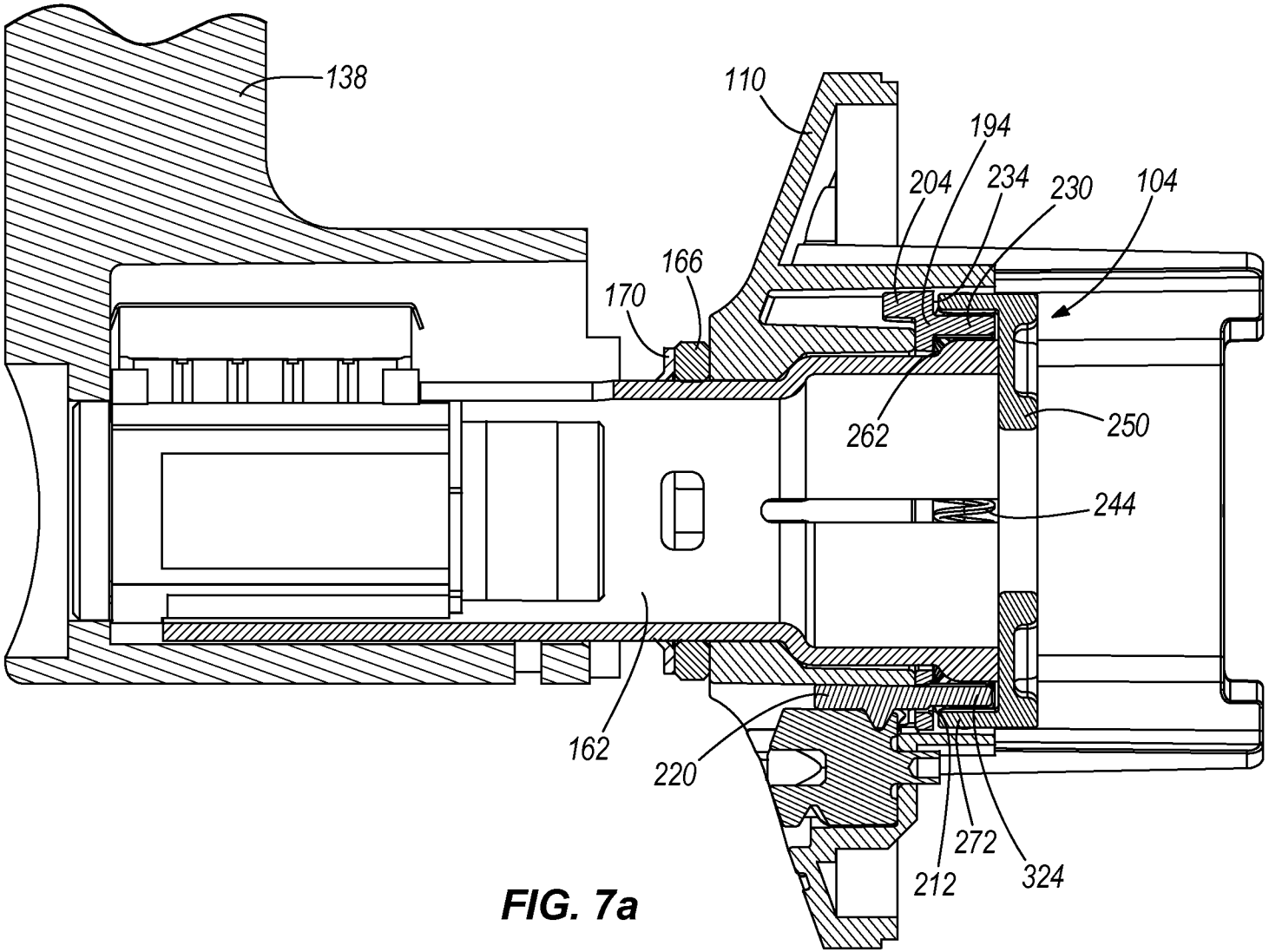
FIG. 7*a* is a section view taken along line 7*a*-7*a* of FIG. 2*b*.
Figure 7B:
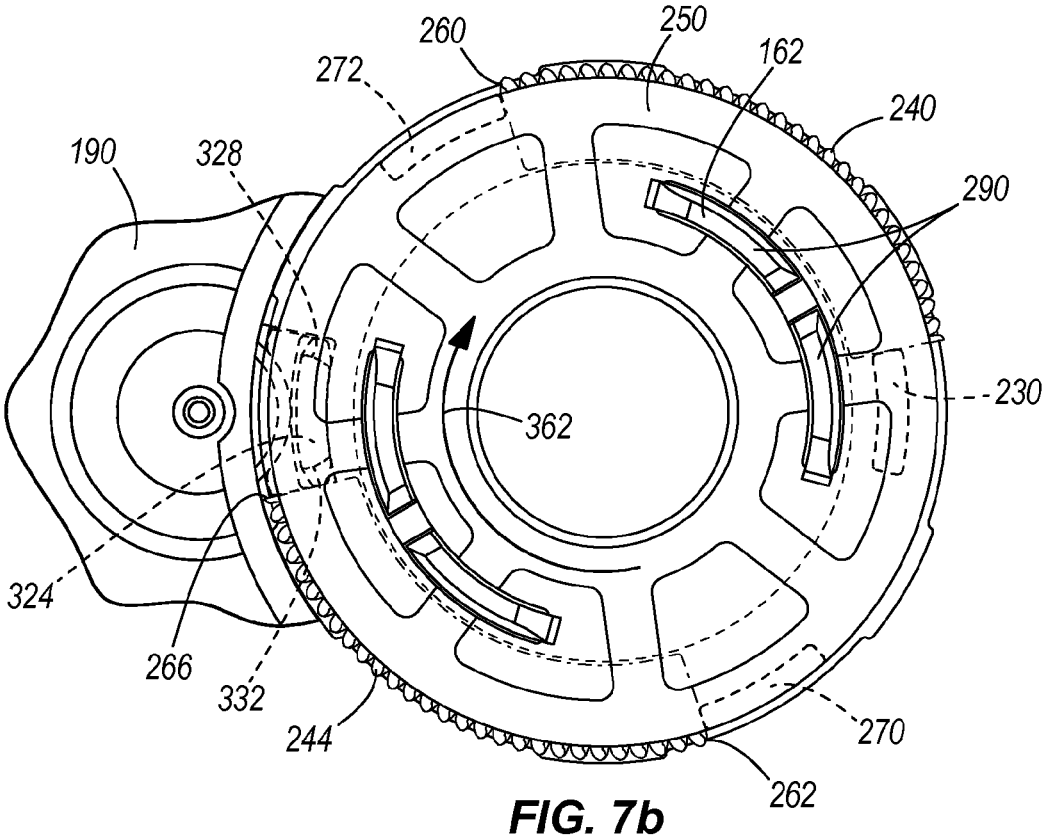
FIG. 7*b* is an end view of the lock assembly of FIG. 7*a* with clockwise rotation of the spindle.
Figure 7C:
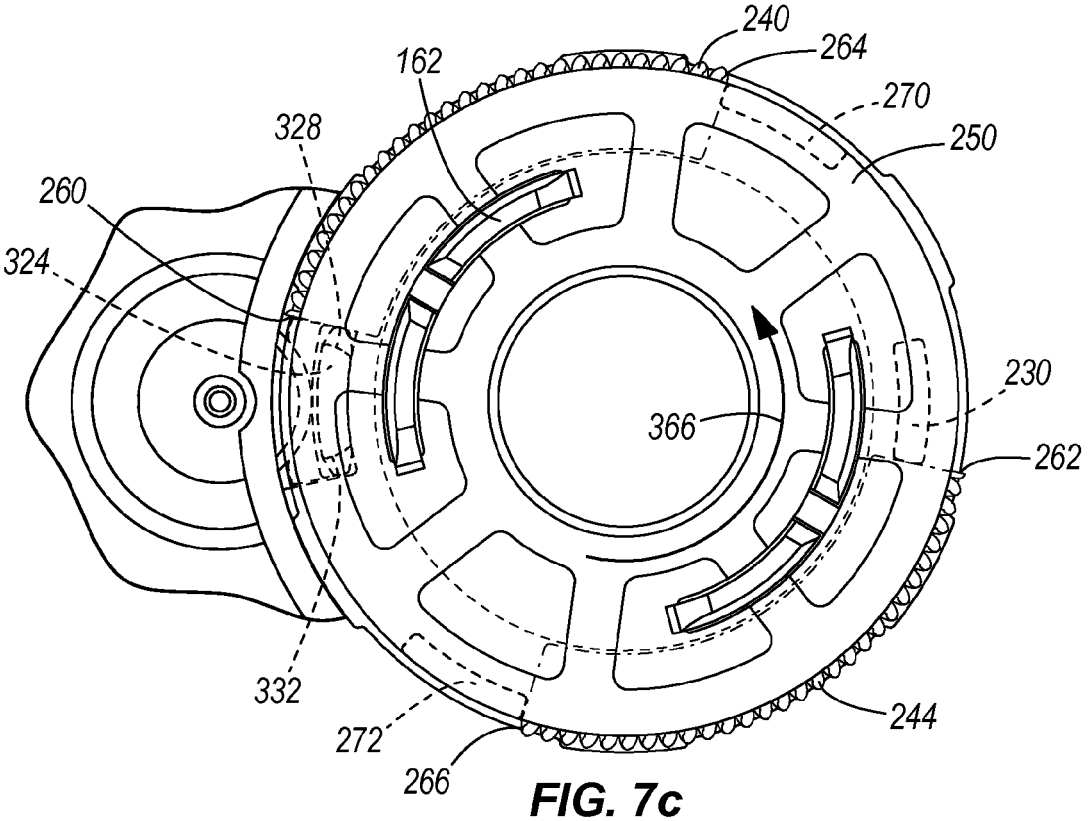
FIG. 7*c* is an end view of the lock assembly of FIG. 7*a* with counterclockwise rotation of the spindle.

FIGS. 7*a*-7*c* show a lever configuration. Referring to FIG. 7*a*, the locking assembly 104 is shown in a neutral position with no torque applied to the lever 138. In this configuration, the positioning member 324 of the actuator 220 extends through the slot 212 of the back plate 194. The stop 230 is again fixed in place.

Referring to FIG. 7*b*, in operation, during a clockwise rotation of the spindle 162 (see arrow 362) due to rotation of the lever 138 (not shown), the protrusion 272 contacts the first end 260 of the spring 240 and compresses the spring 240 against the back plate stop 230, as in FIG. 6*b*, to provide a counter torque to the applied torque of the lever. Since the positioning member 324 is now fixed in place with the second contact surface 332 adjacent the second end 266 of the lower spring 244, the protrusion 270 contacts the first end 262 of the lower spring 244 and compresses the lower spring 244 against the second contact surface 332. Thus, both the upper biasing spring 240 and the lower biasing spring 244 are concurrently compressed, effectively adding their spring constants together in a mechanically parallel spring relationship to counter the torque applied at the lever. Referring to FIG. 7*c*, during a counterclockwise rotation of the spindle 162 (see arrow 366), the protrusion 272 contacts the second end 266 of the lower spring 244 and compresses it against the stop 230, as in FIG. 6*c*. With the first contact surface 328 adjacent the first end 260 of the upper spring 240, the protrusion 270 contacts the second end 264 of the upper spring 240 and compresses the upper spring 240 against the first contact surface 328. The springs 240, 244 are again concurrently compressed in a mechanically parallel spring relationship to counter the torque applied by the lever. Thus, the lever arrangement receives about twice the restoring force as the knob arrangement.

Figure 8A:
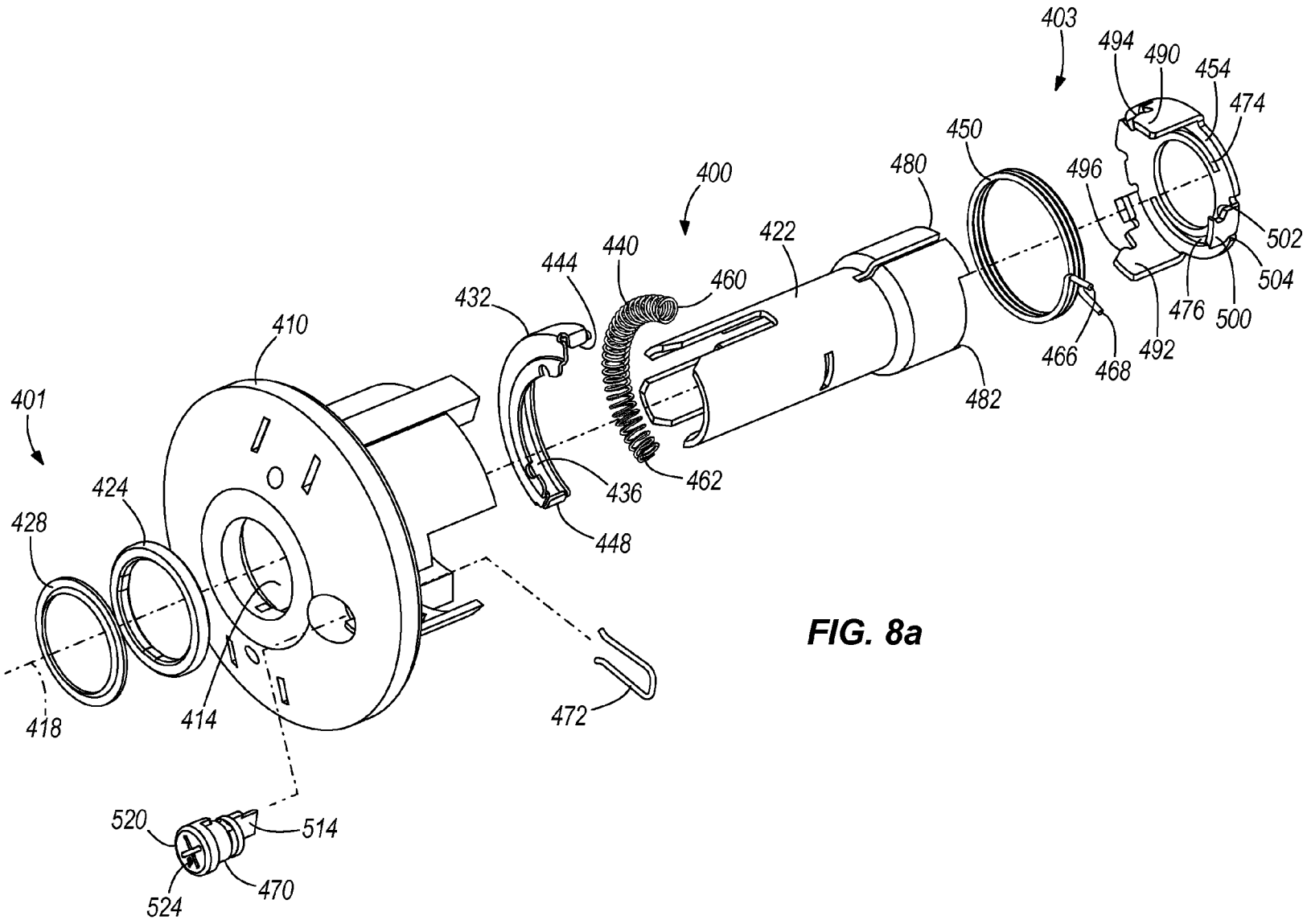
FIG. 8*a* is an exploded view of another selectable lock assembly.
Figure 8B:
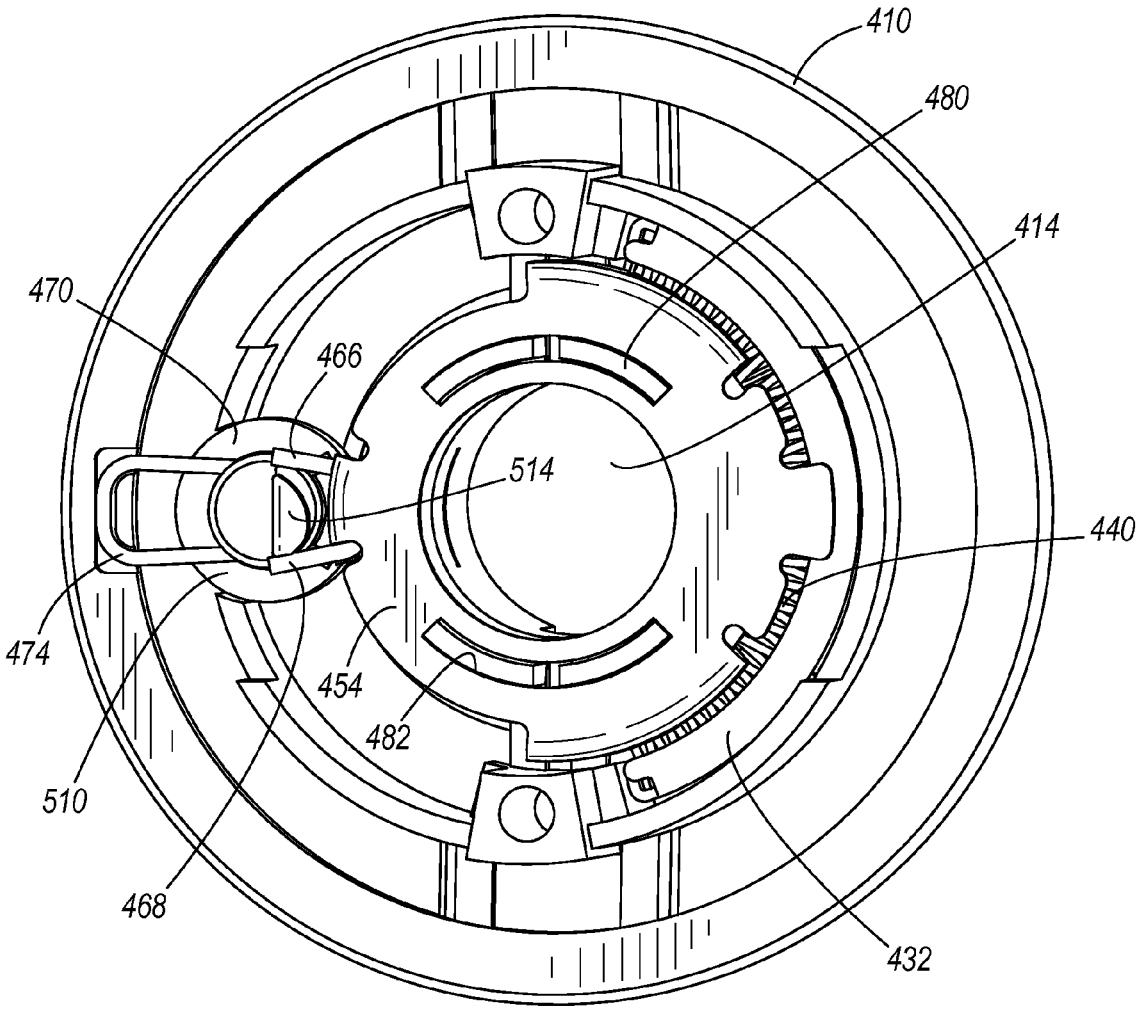
FIG. 8*b* is a perspective view of the selectable lock assembly of FIG. 8*a* as assembled.

FIG. 8*a* illustrates another selectable lock assembly 400, unassembled and referenced with respect to a proximal end 401 and a distal end 403. FIG. 8*b* illustrates the lock assembly 400 as assembled. Referring to FIGS. 8*a*-8*b*, the selectable lock assembly 400 includes a lock housing 410 defining an aperture 414 with a central axis 418 through which a spindle 422 rotates in response to actuation of a handle or a lever (not shown) to move a latch (not shown) from an extended position to a refracted position. The spindle 422 receives a lock cylinder (not shown) and is externally secured through a retainer 424 and a retainer ring 428 that seat against the housing 410.

With continued reference to FIGS. 8*a* and 8*b*, a spring holder 432 fixedly disposed within the housing 410 provides an arcuate track 436 for a first biasing spring 440. In the present construction, the first biasing member or spring 440 is a linear compression spring with first and second ends 460, 462. Lips 444, 448 at each end of the spring holder 432 constrain the motion of the first biasing spring 440 to deflection within the track 436. A second biasing member or spring 450 is functionally disposed adjacent a retainer member, or spring cage 454. The second biasing spring 450 is a torsion spring with first and second ends or legs 466, 468 positioned to engage an actuator 470 secured to the housing 410 with a clip 472. The spring cage 454 includes two generally curvilinear openings 474, 476 therethrough that mate with conforming slotted extensions 480, 482 formed at the distal end of the spindle 422. The spring cage 454 therefore rotates with rotation of the spindle 422. Extending proximally from the spring cage 454 are first and second protrusions 490, 492 that interact with the first biasing spring 440. Specifically, the first and second protrusions 490, 492 include lateral edges 494, 496 shaped to abut the first and second ends 460, 462, respectively, of the first biasing spring 440. An arm 500 also extending in the proximal direction from the spring cage 454 includes opposing grooves 502, 504 configured to catch the first and second ends 466, 468 of the second biasing spring 450. The linear spring constant of the first biasing spring 440 and the torsion spring constant of the second biasing spring 450 may or may not be functionally equivalent, i.e., the combined spring rate for a lever installation can vary depending on the desired ratio between knob and lever installations.

The actuator 470 is generally cylindrical in form and includes an engagement interface 520 operable with a screwdriver or similar tool. An identifier 524 describes the current state of the actuator (knob or lever) in the same manner as described for FIGS. 2*a* and 2*b*. A semicircular shaft 514 extends eccentrically from the distal face 510 of the actuator 470.

Figure 9A:
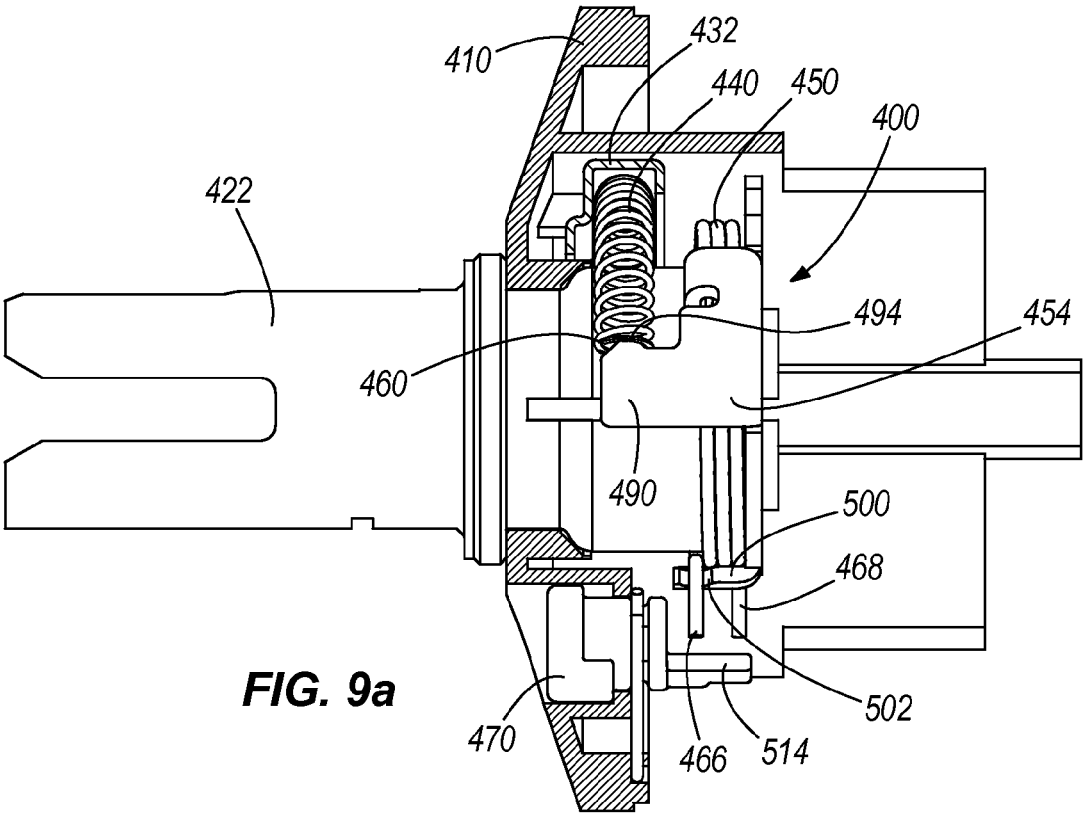
FIG. 9*a* is a top view of the selectable lock assembly of FIG. 8*b* with the actuator disengaged.
Figure 9B:
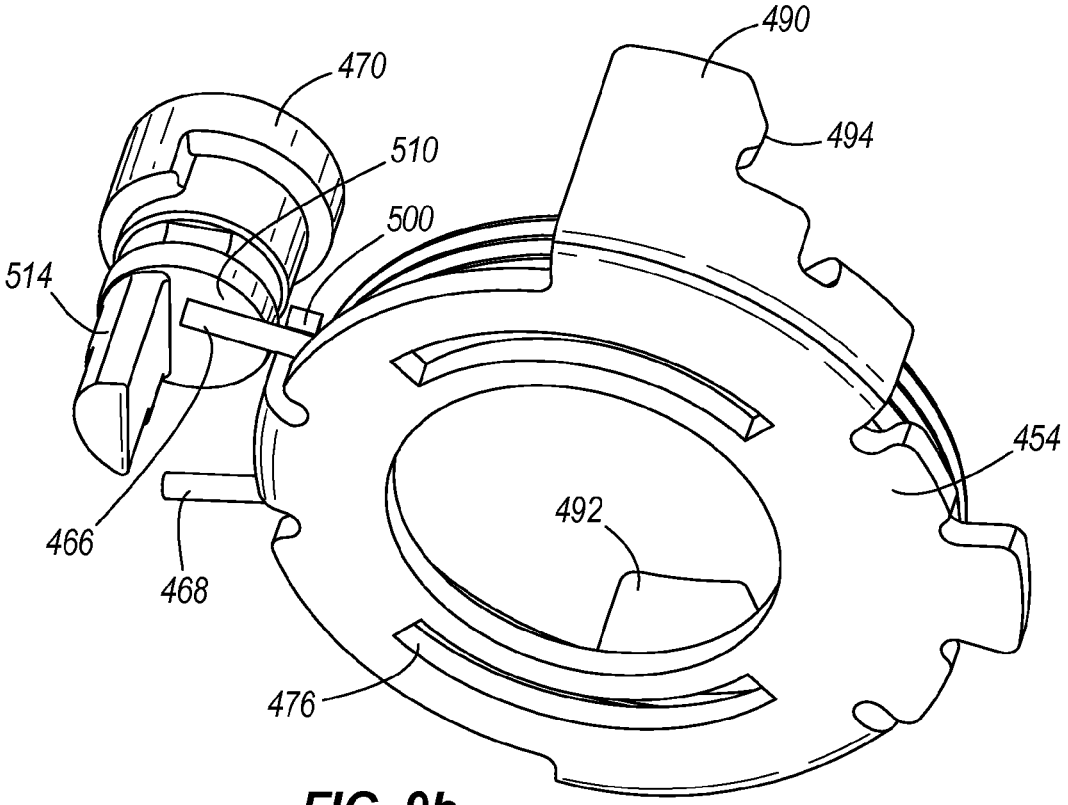
FIG. 9*b* is a perspective view of the actuator of the selectable lock assembly of FIG. 9*a*.

Referring to FIGS. 9*a* and 9*b*, the locking assembly 400 is shown in a neutral position with no torque applied to the spindle 422. With the actuator 470 positioned for a knob handle, the first and second ends 466, 468 of the second biasing spring 450 are clear of the shaft 514, i.e., the shaft 514 is not in engagement with either of the first or second ends 466, 468 of the torsion spring 450. In operation, during clockwise rotation of the spindle 422, which rotates the spring cage 454, the first biasing spring 440 is deflected against the lip 448 (not shown) of the spring holder 432 by the interaction of the first lateral edge 494 of the protrusion 490 of the spring cage 454 against the end 460 of the first biasing spring 440. The torsion spring 450 is free to rotate with the spring cage 422 via arm 500 unhindered by the shaft 514 of the actuator 470. During counterclockwise rotation of the spindle 422, which also rotates the spring cage 454, the first biasing spring 440 is deflected against the lip 444 of the spring holder 432 by the interaction of the second lateral edge 496 of the protrusion 492 (not shown) of the spring cage 454 against the end 462 of the first biasing spring 440. The only counter torque applied to the spindle 422 in either case is therefore by virtue of deflection of the first biasing spring 440.

Figure 10A:
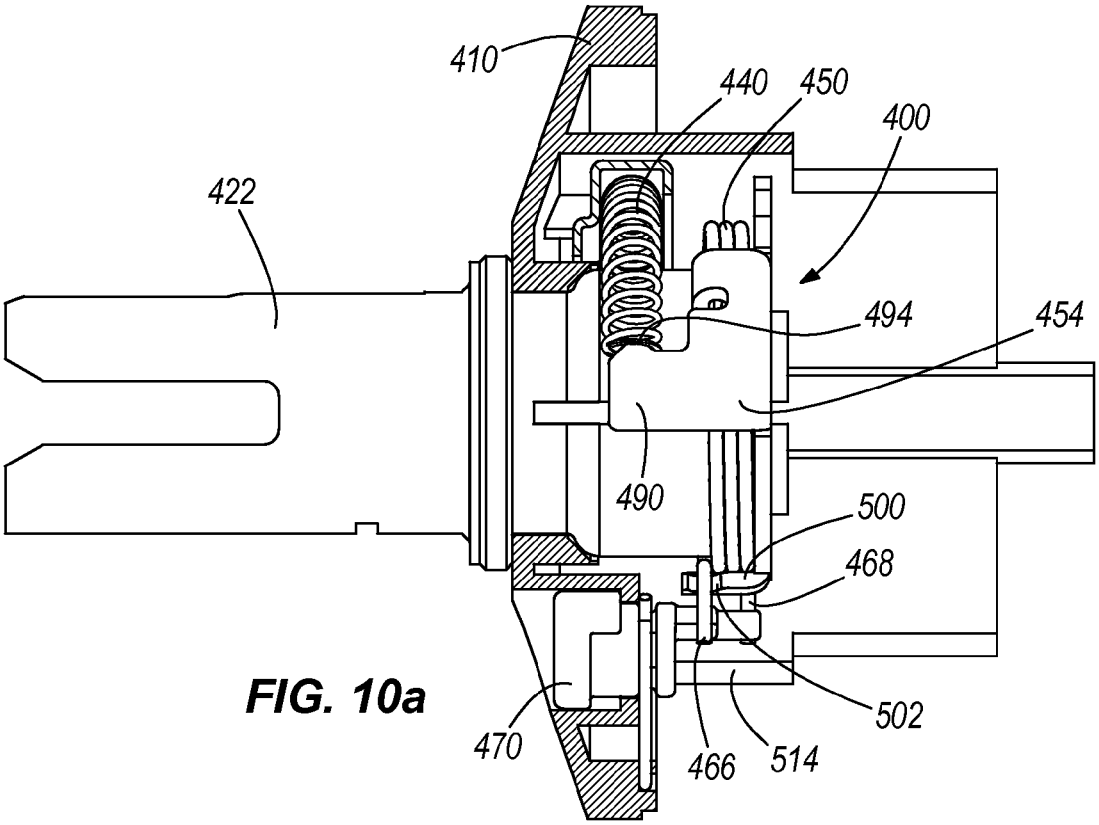
FIG. 10*a* is a top view of the selectable lock assembly of FIG. 8*b* with the actuator engaged.
Figure 10B:
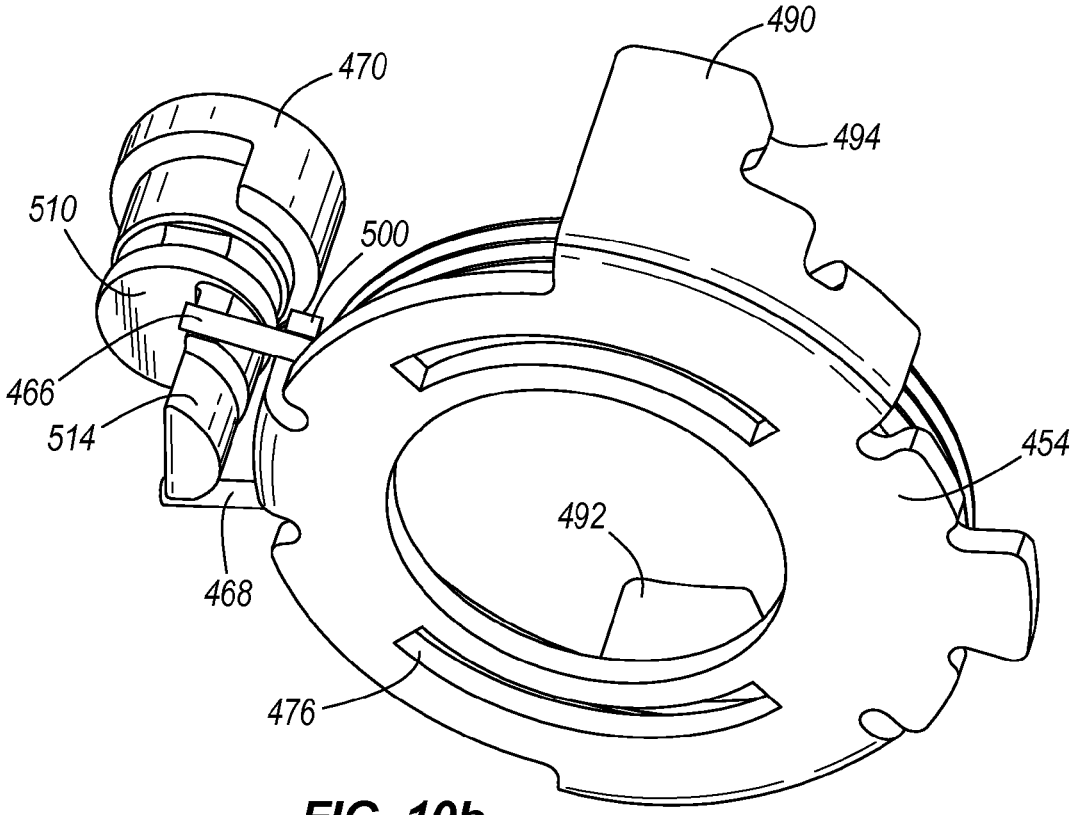
FIG. 10*b* is a perspective view of the actuator of the selectable lock assembly of FIG. 10*a*.

FIGS. 10*a* and 10*b* also show the locking assembly 400 in a neutral position. Turning the actuator 470 to 'lever' from 'knob' rotates and repositions the shaft 514 between the first and second ends 466, 468 of the second biasing spring 450. In operation, during clockwise or counterclockwise rotation of the spindle 422, the first biasing spring 440 is deflected by the spring cage 454 as previously described, but the second biasing spring 450 is no longer free to rotate with the spring cage 454. During clockwise rotation, the end 468 of the second biasing spring 450 is operably fixed against the shaft 514 while force is applied to the end 466 by the groove 502 of the arm 500. During counterclockwise rotation of the spindle 422, the end 466 of the second biasing spring 450 is operably fixed against the shaft 514 while force is applied to the end 468 by the groove 504. Separation of the ends 466, 468 through rotation, which deflects the spring 450, applies torque to the spindle 422 in excess of that supplied by the first biasing spring 440 alone.

Figure 11A:
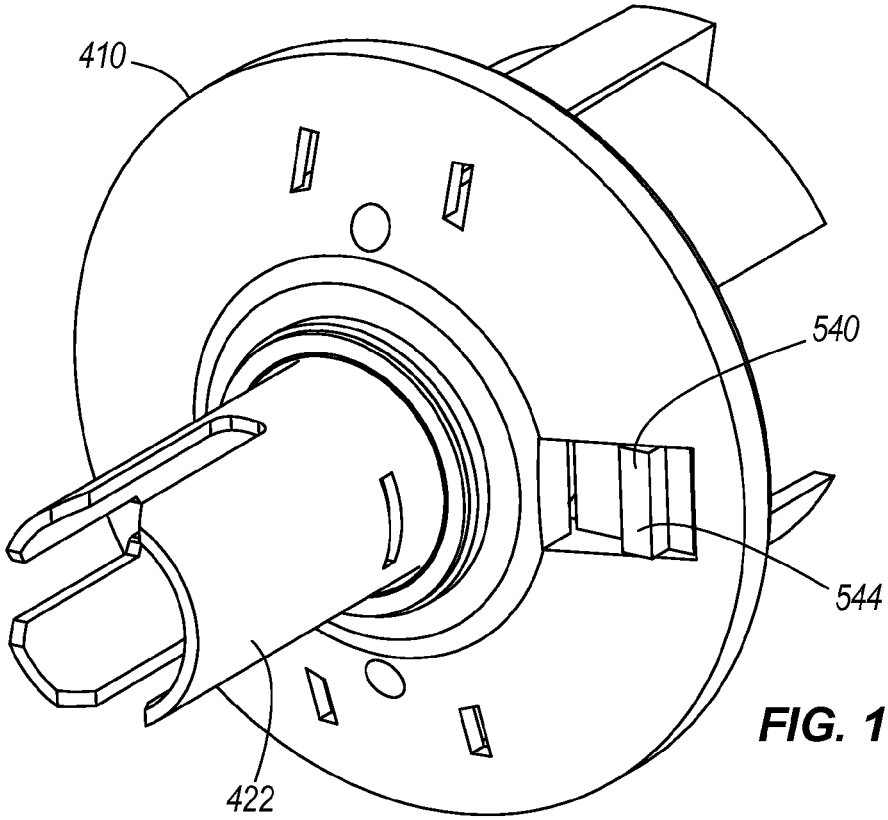
FIG. 11*a* is a perspective view of an alternative actuator with the selectable lock assembly of FIG. 8*a* and in the disengaged position.
Figure 11B:
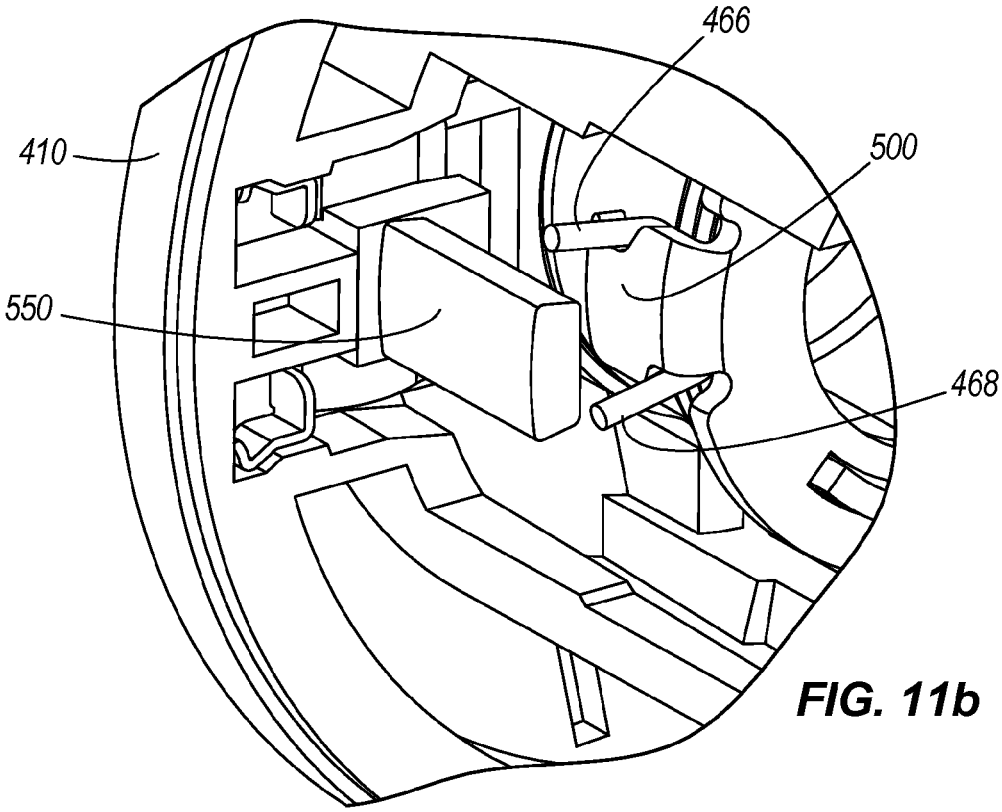
FIG. 11*b* is a partial perspective view of the actuator of FIG. 11*a*.
Figure 12A:
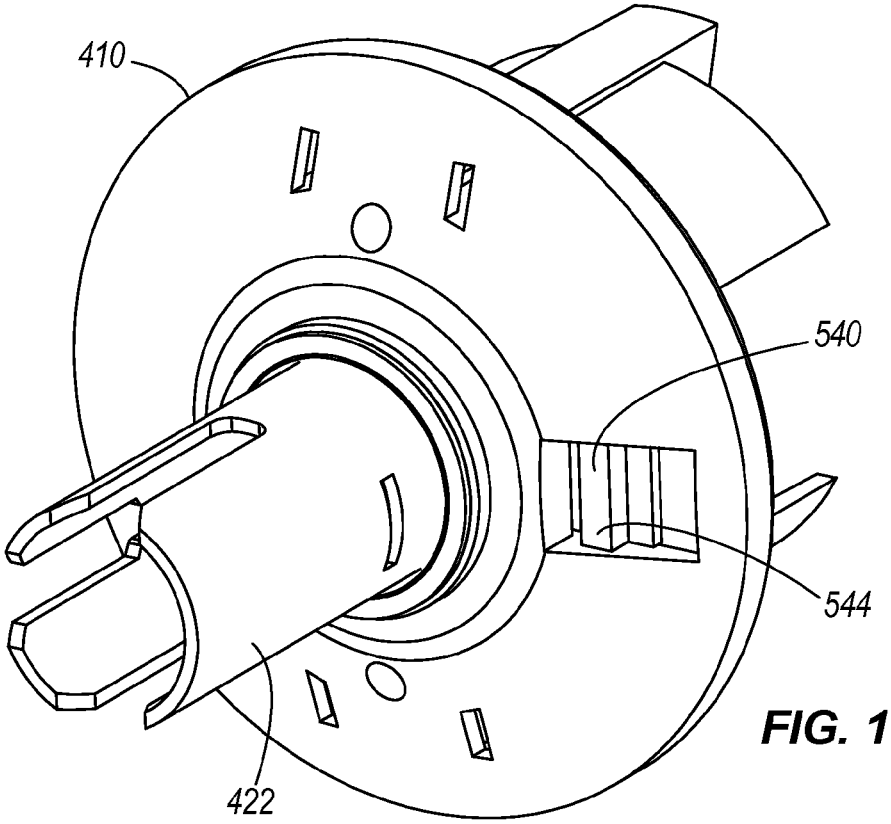
FIG. 12*a* is a perspective view of the actuator of FIG. 11*a* in the engaged position.
Figure 12B:
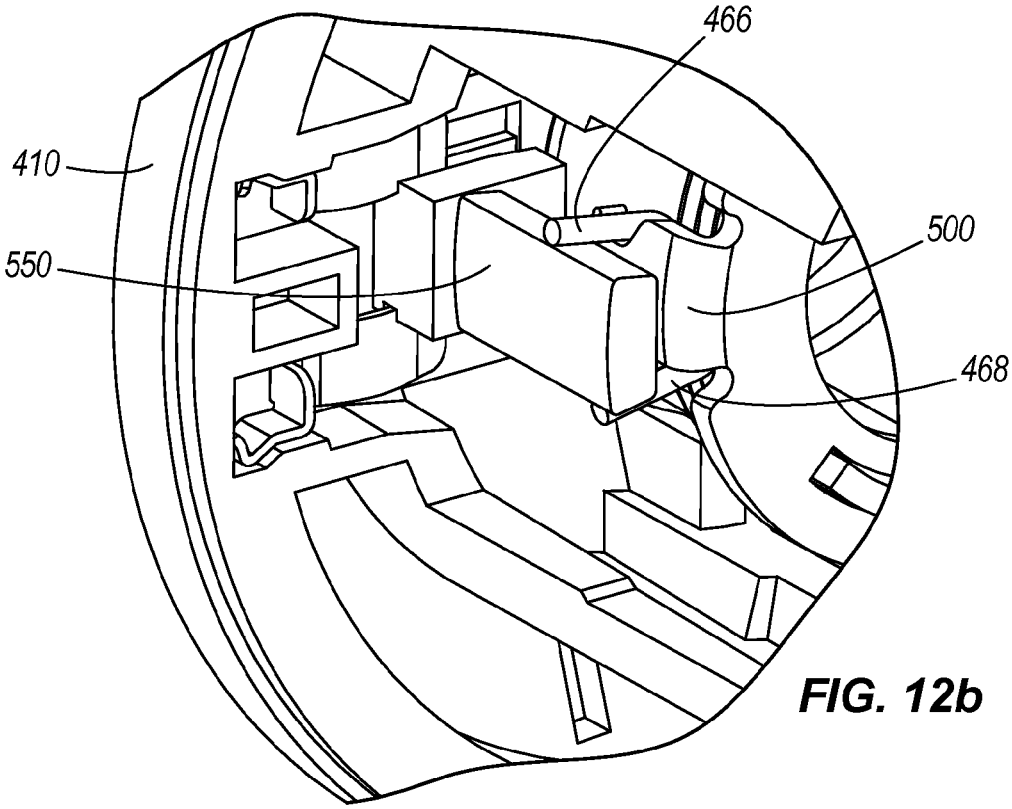
FIG. 12*b* is a partial perspective view of the actuator of FIG. 12*a*.

Referring to FIGS. 11*a* and 11*b*, an alternative actuator 540 is shown disposed within the housing 410. The actuator 540 includes an accessible slide switch 544 with two positions. In FIG. 11*a*, the slide switch 544 is selected for a knob handle. As shown in FIG. 11*b*, the first and second ends 466, 468 of the second biasing spring 450 are clear of the blocking bar 550 of the actuator 540 and the second biasing spring 450 is free to rotate with the spindle 422 in the same manner previously described. In FIG. 12*a*, the slide switch 544 is selected for a lever handle and as shown in FIG. 12*b*, the blocking bar 550, through radially inward movement, is functionally disposed between the first and second ends 466, 468 of the second biasing spring 450, activating the second biasing spring 450 as previously described.

Figure 13A:
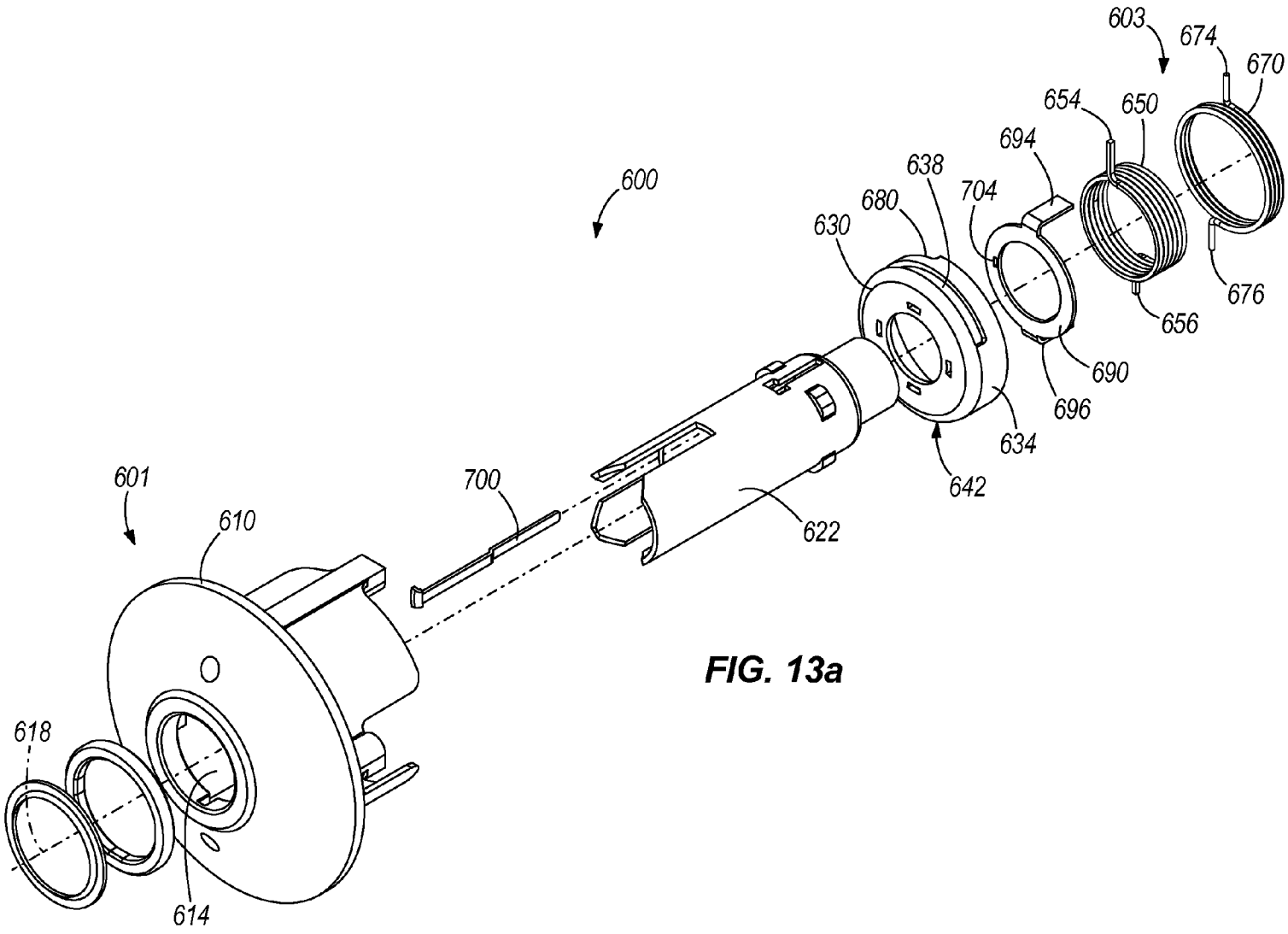
FIG. 13*a* is an exploded view of another selectable lock assembly.
Figure 13B:
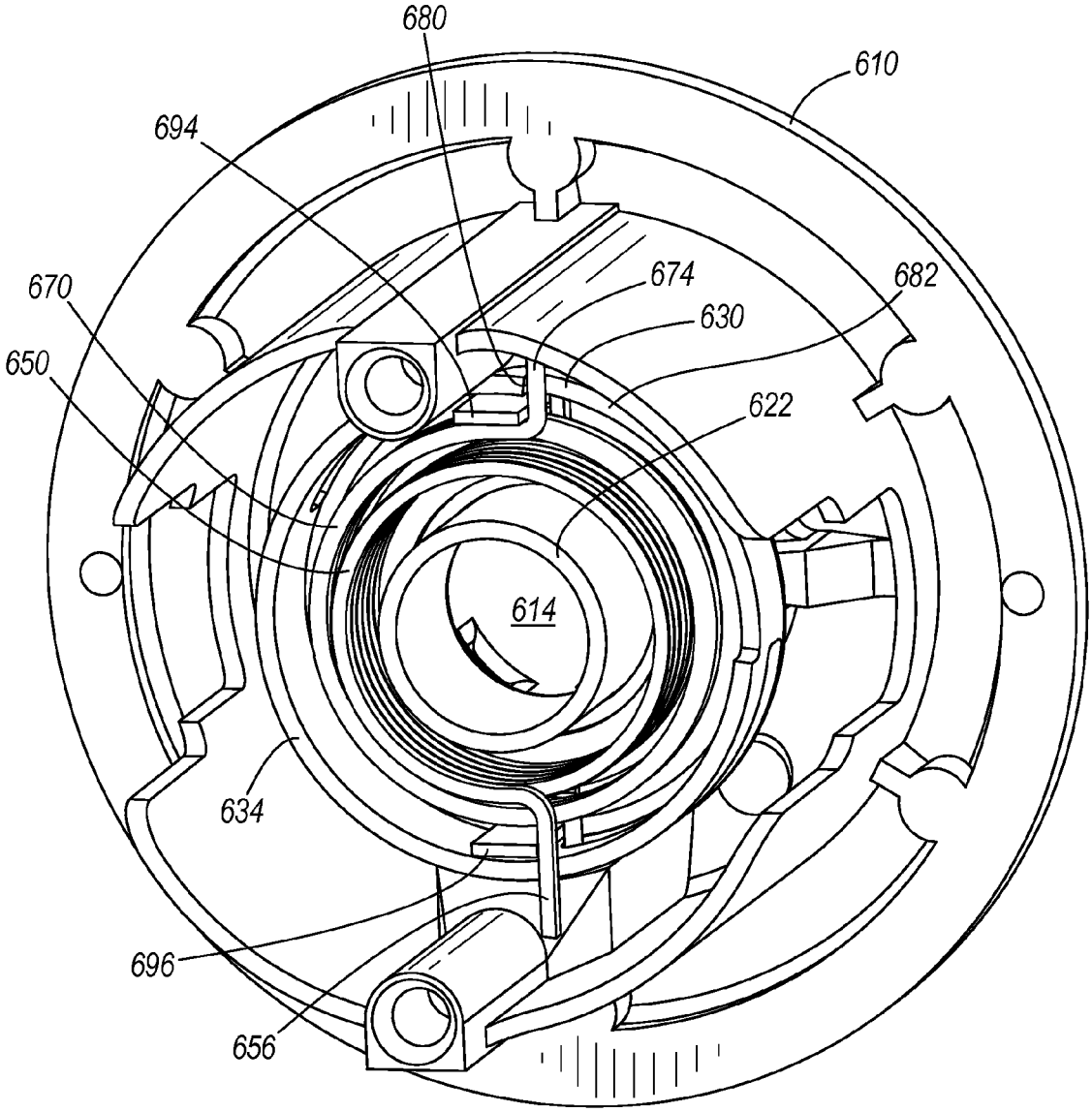
FIG. 13*b* is a perspective view of the selectable lock assembly of FIG. 13*a* as assembled.

FIG. 13*a* illustrates another selectable lock assembly 600, unassembled and referenced with respect to a proximal end 601 and a distal end 603. FIG. 13*b* illustrates the lock assembly 600 as assembled. Referring to FIGS. 13*a* and 13*b*, a housing 610 includes an aperture 614 defining a central axis 618 that receives a spindle 622. The spindle 622 rotates with the actuation of a handle or a lever (not shown) to move a latch (not shown) from an extended position to a retracted position. A spring plate 630 is rotatably fixed to the spindle 622 and includes a distally extending slotted wall 634 with upper and lower slots 638, 642. A lever biasing member or spring 650 with a right-hand winding has an upper leg 654 and a lower leg 656 and is situated such that the upper leg 654 extends upward through the upper slot 638 of the spring plate 630 and the lower leg 656 extends downward distally of the slotted wall 634. A knob biasing member or spring 670 with a left-hand winding and larger mean diameter than the lever spring 650 is concentrically nested over the lever spring 650 and has an upper leg 674 and a lower leg 676. The upper leg 674 extends upward distally of the slotted wall 634 and abuts the edge 680 of a groove 682 formed in the wall 634, best seen in FIGS. 15*a* and 16*a*. The lower leg 676 extends downward through the lower slot 642 of the spring plate 634 and abuts an edge 684 formed in the spring plate 630. As illustrated, the lever spring 650 and the knob spring 670 are torsion springs. Alternative nested designs of the lever spring 650 and the knob spring 670 can be achieved by varying the coil winding direction, mean spring diameter, and spring leg orientation of each spring.

With continued reference to FIGS. 13*a* and 13*b*, a lever spring plate 690 sits within the knob spring plate 630 enclosed by the slotted wall 634 and includes a pair of opposed distally extending arcuate arms 694, 696 positioned radially between the slotted wall 634 and the lever spring 670. The lever spring plate 690 is selectively engaged and activated to rotate with the spindle 622 by actuation of an engagement rod or actuator 700 through a plate orifice 704, as further described below.

Figure 14:
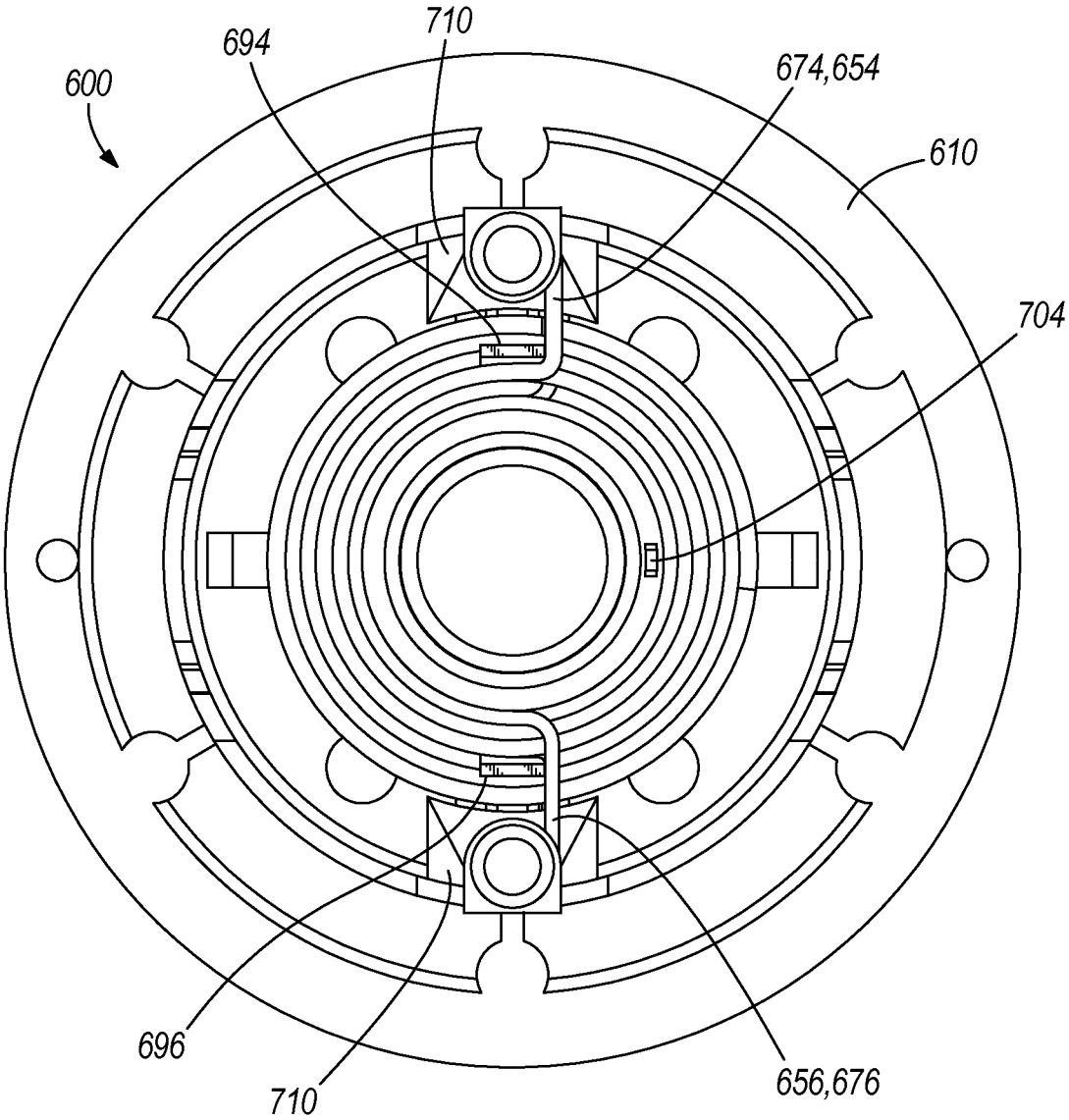
FIG. 14 is an end view of the lock assembly of FIG. 13*b*.

Referring to FIG. 14, an end view of the lock assembly 600 shows that the upper and lower legs 674, 676 of the knob spring 670 and the upper and lower legs 654, 656 of the lever spring 650 are held against rotation in one direction by diametrically opposed bosses 710 integrally formed as part of the lock housing 610. As illustrated, the upper legs 674, 654 are blocked from counterclockwise rotation and the lower legs 656, 676 are blocked from clockwise rotation.

Figure 15A:
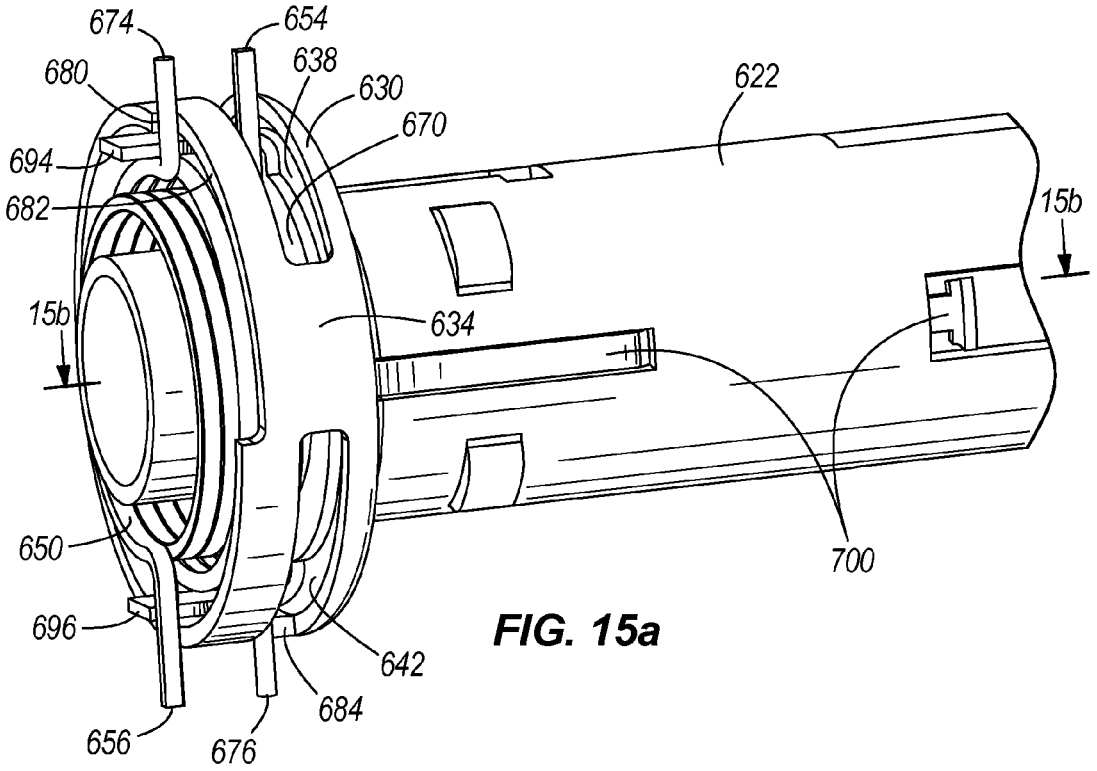
FIG. 15*a* is a perspective view of the selectable lock assembly of FIG. 13*b* with the engagement rod disengaged.
Figure 15B:
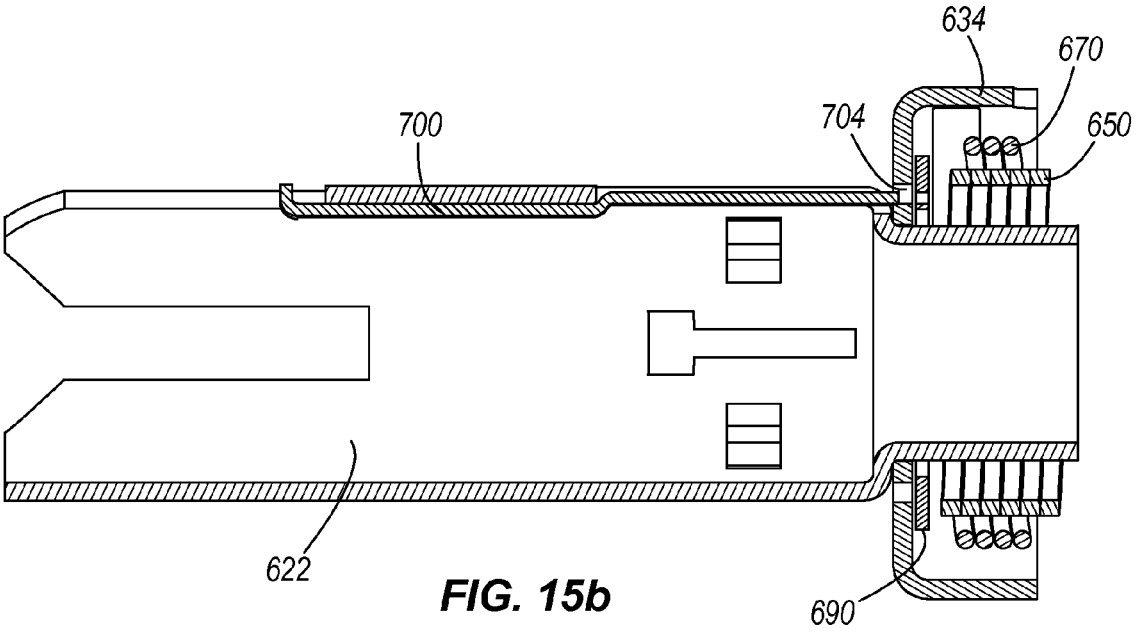
FIG. 15*b* is a section view taken along line 15*b*-15*b* of FIG. 15*a*.

Referring to FIGS. 15*a* and 15*b*, the locking assembly 600 is shown in a neutral position with no external torque applied. In the knob configuration, the actuator 700 is retracted and does not extend through the orifice 704 in the lever spring plate 690. In operation, upon clockwise or counterclockwise rotation of the spindle 622, the knob spring 670 is deflected by interaction with the edges 680, 684 in the knob spring plate 690. Specifically, with clockwise rotation of the spindle 622 (viewed from the end), the edge 680 contacts and rotates the upper end 674 of the knob spring 670 against the operably fixed lower end 676, and the upper slot 638 passes over and does not interact with the upper leg 654 of the lever spring 650. With counterclockwise rotation of the spindle 622, the edge 684 formed in the slotted wall 634 contacts and rotates the lower leg 676 of the knob spring 670 against the operably fixed upper leg 674. Thus, counter torque to the actuation of the knob is provided by the knob spring 670 only. The lever spring plate 690 does not rotate with the spindle 622 until it is selectively engaged by the actuator 700.

Figure 16A:
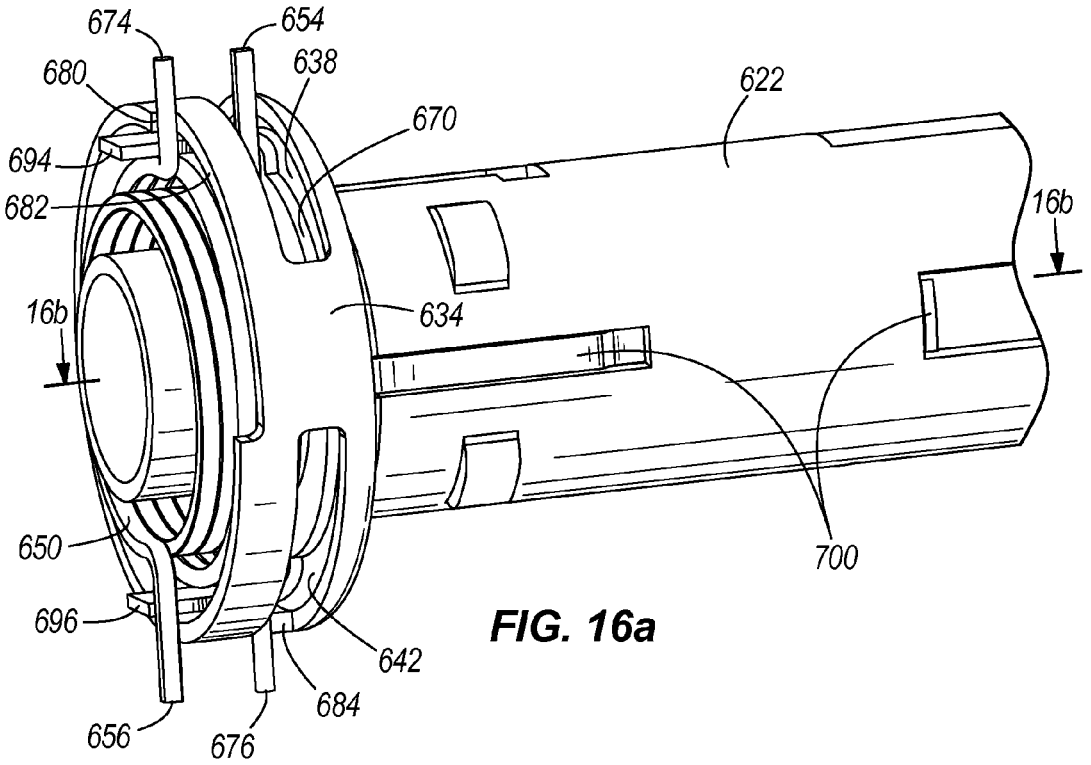
FIG. 16*a* is a perspective view of the selectable lock assembly of FIG. 13*b* with the engagement rod engaged.
Figure 16B:
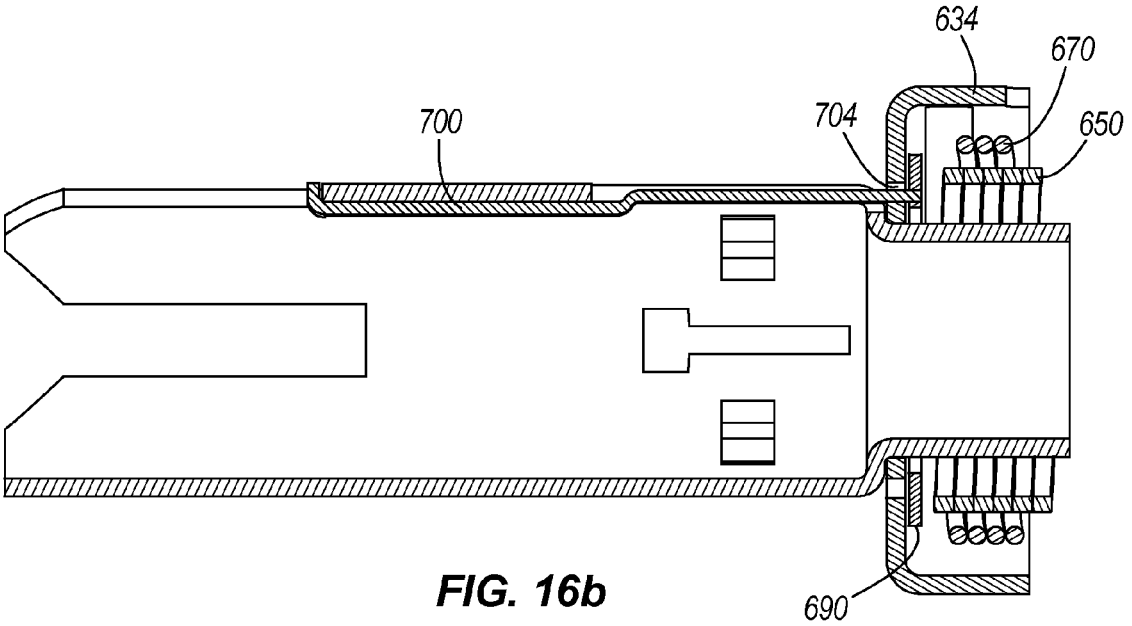
FIG. 16*b* is a section view taken along line 16*b*-16*b* of FIG. 16*a*.

Referring to FIGS. 16*a* and 16*b*, in the neutral position of the lever configuration, the actuator 700 is pushed into the lever spring plate orifice 704 to engage the lever spring plate 690. In operation, this causes the lever spring plate 690 to rotate with the spindle 622 and the knob spring plate 630. The interaction of the knob spring plate 630 and the knob spring 670 remains as previously described. With clockwise rotation of the spindle 622, the upper arcuate arm 694 of the lever spring plate 690 contacts and rotates the upper leg 654 of the lever spring 650 to deflect it against the operably fixed lower leg 656 of the lever spring 650. With counterclockwise rotation of the spindle 622, the lower arcuate arm 696 contacts and rotates the lower leg 656 of the lever spring 650 against the operably fixed upper leg 654. Due to the geometry of the lever spring plate 690, the upper and lower arcuate arms 694, 696 also contact and rotate the upper and lower legs 674, 676 of the knob spring 670 in conjunction with the knob spring plate 630 as described in FIGS. 15*a*-15*b*. The counter torque to the actuation of the lever is thus provided by the combination of the knob spring 670 and the lever spring 650.

To switch from a knob trim to a lever trim, the user first removes the existing trim, manually alternates the selector 100 or actuator 470 (with, for example, a screwdriver) or slides the actuator 540 or 700 to the proper trim mode, and installs a new trim. Disassembly of the lock assembly 104, 400, 600 is not required.

The single lock assembly 104, 400, 600 as described provides more than one spring rate to accommodate different trim configurations. This benefits manufacturers by reducing the number of parts necessary to be manufactured, stored and tracked, and benefits consumers by offering an easy opportunity to upgrade from knobs to levers without the need to purchase a new lock chassis assembly.

Various features and advantages of the invention are set forth in the following claims.

We claim:

1. A latch assembly configured to attach to a door having a first surface, a second surface opposite the first surface, and a door axis therebetween, the latch assembly comprising:

one of a knob and a lever on the first surface extending along the door axis in a direction away from the second surface;

a latch extending from the door;

a spindle rotatable from a first position to a second position to move the latch from an extended position to a retracted position;

a first biasing member selectively operable to bias the spindle toward the first position;

a second biasing member selectively operable to bias the spindle toward the first position;

an actuator movable between a knob position in which only one of the first biasing member and the second biasing member biases the spindle toward the first position and a lever position in which both the first biasing member and the second biasing member cooperate to bias the spindle toward the first position and an adjustment member operable to move the actuator between the knob position and the lever position, wherein the adjustment member is disposed outside of the door along the door axis on a side of the first surface opposite the second surface.

2. The latch assembly of claim 1, wherein the spindle is rotatable from the first position to a third position to move the latch from the extended position to the refracted position, and wherein the second position is clockwise of the first position and the third position is counterclockwise of the first position.

3. The latch assembly of claim 1, wherein the first biasing member is a first spring and the second biasing member is a second spring.

4. The latch assembly of claim 3, wherein the first spring and the second spring have equal spring constants.

5. The latch assembly of claim 3, wherein the first spring is a compression spring and the second spring is a compression spring.

6. The latch assembly of claim 3, wherein the first spring is a compression spring and the second spring is a torsion spring.

7. The latch assembly of claim 3, wherein the first spring is a torsion spring and the second spring is a torsion spring.

8. A latch assembly configured to attach to a door, the latch assembly comprising:

a latch extending from the door;

a housing coupled to the door and having an aperture defining a central axis therethrough;

a spindle received and configured to rotate within the aperture and to extend and retract the latch;

first and second biasing springs contained within the housing;

an actuator selectively movable to an operable position in which rotation of the spindle deflects the first and second biasing spring, and an inoperable position in which rotation of the spindle deflects only the first biasing spring; and wherein the first and second biasing springs each have a first and second end, and wherein in the operable position, the actuator is centered between one of the first end and the second end of the first biasing spring and one of the first end and second end of the second biasing spring.

9. The latch assembly of claim 8, wherein the spindle is rotatable from a first position to a second position to extend and retract the latch and rotatable from the first position to a third position to extend and retract the latch, and wherein the second position is clockwise of the first position and the third position is counterclockwise of the first position.

10. The latch assembly of claim 8, further including an adjustment member configured to move the actuator between the operable position and the inoperable position.

11. The latch assembly of claim 10, wherein the adjustment member is rotatable within the housing.

12. The latch assembly of claim 8, wherein the actuator is configured to translate axially from the operable position to the inoperable position.

13. The latch assembly of claim 12, wherein the actuator is configured to translate axially from the operable position to the inoperable position in response to rotation of an adjustment member.

14. A latch assembly configured to attach to a door, the latch assembly comprising:

a spindle rotatable about a central axis to move a latch from an extended position to a retracted position in the door;

an annular plate fixed with respect to the door and including a slot, a plate face, and a plate projection extending from the plate face;

a retainer member including a retainer face, a first retainer protrusion extending from the retainer face, and a second retainer protrusion extending from the retainer face, the retainer member coupled to the spindle and rotatable about the central axis;

a first spring disposed between the plate face of the annular plate and the retainer face of the retainer member;

a second spring disposed between the plate face of the annular plate and the retainer face of the retainer member, wherein the first spring and the second spring are movable with the plate projection, the first retainer protrusion, and the second retainer protrusion; and an actuator selectively movable between a retracted position and an extended position through the slot to place the first spring and the second spring into a mechanically parallel relationship.

15. The latch assembly of claim 14, wherein the spindle is rotatable from a first position to a second position to move the latch from the extended position to the retracted position and rotatable from the first position to a third position to extend and retract the latch, and wherein the second position is clockwise of the first position and the third position is counterclockwise of the first position.

16. The latch assembly of claim 14, wherein the first spring and the second spring have equal spring constants.

17. The latch assembly of claim 14, wherein the first spring is a compression spring and the second spring is a compression spring.

18. The latch assembly of claim 14, further including an adjustment member configured to move the actuator between the retracted position and the extended position.

* * * * *